US005575226A

United States Patent [19]

Badillo et al.

[11] Patent Number: 5,575,226

[45] **Date of Patent: *Nov. 19, 1996**

[54] SEWING AND MATERIAL REMOVAL ASSEMBLY

[75] Inventors: Ralph Badillo; Paul Badillo, both of Littleton, Colo.

[73] Assignee: Ralph's Industrial Sewing Machine Company, Denver, Colo.

[ * ] Notice: The term of this patent shall not extend beyond the expiration date of Pat. No. 5,456,194.

[21] Appl. No.: 286,640

[22] Filed: Aug. 5, 1994

Related U.S. Application Data

[63] Continuation-in-part of Ser. No. 24,687, Mar. 1, 1993, Pat. No. 5,339,756, which is a continuation of Ser. No. 764,332, Sep. 23, 1991, Pat. No. 5,193,471, which is a continuation-in-part of Ser. No. 633,497, Dec. 26, 1990, Pat. No. 5,158,026.

[51] Int. Cl.[6] ..... D05B 3/06

[52] U.S. Cl. ..... 112/68; 112/70; 112/475.25

[58] Field of Search ..... 112/68, 70, 261, 112/475.25, 447, 122, 130, 66, 73

[56] References Cited

U.S. PATENT DOCUMENTS

| | | | |
|---|---|---|---|
| /45,663 | 7/1886 | Blodgett . | |
| 1,225,247 | 5/1917 | Hill . | |
| 1,650,588 | 11/1927 | Allen . | |
| 2,515,740 | 7/1950 | Smith et al. | 112/66 |
| 2,954,001 | 9/1960 | Luxenburg | 112/66 |
| 3,111,921 | 11/1963 | Kleemann et al. | 112/261 |
| 3,948,194 | 4/1976 | Gunold | 112/131 |
| 4,077,340 | 3/1978 | Braun et al. | 112/131 |
| 4,501,207 | 2/1985 | Miyazaki et al. | 112/66 |
| 4,565,142 | 1/1986 | McGann | 112/260 |
| 4,589,358 | 5/1986 | Goldbeck et al. | 112/68 |
| 4,735,160 | 4/1988 | Hampel et al. | 112/288 |
| 5,085,157 | 2/1992 | Jung et al. | 112/68 |
| 5,158,026 | 10/1992 | Badillo et al. | 112/261 |
| 5,193,471 | 3/1993 | Badillo et al. | 112/68 |
| 5,339,756 | 8/1994 | Badillo et al. | 112/68 |
| 5,456,194 | 10/1995 | Badillo | 112/68 X |

FOREIGN PATENT DOCUMENTS

| | | |
|---|---|---|
| 7634151 | 10/1976 | Germany . |

*Primary Examiner*—Paul C. Lewis
*Attorney, Agent, or Firm*—Sheridan Ross & McIntosh

[57] ABSTRACT

An assembly performing for performing both material removal and sewing operations on stitchable material. In one embodiment, the assembly includes sewing and material removal units which are interconnected in a manner such that the sewing unit's sewing area is isolated from the material removal unit. Preferably, the material removal unit is separable from the sewing unit. In another embodiment, the assembly includes sewing and material removal units, the material removal unit including a material removal device, a receiving table with an aperture aligned with the material removal device, and an alignment device which is movable through the aperture to align stitchable material relative to the material removal device.

35 Claims, 15 Drawing Sheets

SEWING AND MATERIAL REMOVAL ASSEMBLY

RELATED APPLICATIONS

This application is a continuation-in-part application of U.S. patent application Ser. No. 08/024,687, filed Mar. 1, 1993 now U.S. Pat. No. 5,339,756, and entitled "MATERIAL REMOVAL DEVICE USED WITH A SEWING MACHINE", which is a continuation of Ser. No. 764,32, filed Sep. 23, 1991 now U.S. Pat. No 5,193,471, issued Mar. 16, 1993, which is a continuation-in-part of Ser. No. 633,497 filed Dec. 12, 1990, now U.S. Pat. No. 5,158,026, issued Oct. 27, 1992.

FIELD OF THE INVENTION

The present invention generally relates to an assembly which provides both sewing and material removal operations. In one aspect, the assembly includes an alignment feature for material removal operations. In another aspect, the assembly's sewing and material removal units are interconnected but isolated such that material from material removal operations does not interfere with sewing operations.

BACKGROUND OF THE INVENTION

A number of programmable sewing machines have been devised and are currently available on the market today, one of which is the Model AMS-206A by Juki. Sewing machines of this type offer a number of advantages. For instance, sewing operations are controlled by computer software. More particularly, sewing patterns stored in computer memory and accessible by the software are used to control the movement of a presser foot assembly which engages and moves the stitchable material relative to the sewing needle to produce a desired, preselected pattern. Consequently, programmable sewing machines are commonly used in commercial, high production applications. One such application is for sewing a selected patterned design around an opening in stitchable material to produce a buttonhole or other desirable design. Although no presently known programmable sewing machine incorporated a punch or other assembly for removing stitchable material prior to that described in U.S. Pat. No. 5,158,026, there are separate punching machines which are commercially available.

Unlike programmable sewing machines, there are non-programmable sewing machines commercially available which integrate a punch assembly with sewing operations. U.S. Pat. No. 345,663 to Blodgett, issued Jul. 20, 1886; U.S. Pat. No. 1,225,247 to Hill, issued May 8, 1917; U.S. Pat. No. 1,650,588 to Allen, issued Nov. 29, 1927; and U.S. Pat. No. 2,515,740 to Smith, et al., issued Jul. 18, 1950 are representative of this type of machine. A number of disadvantages are evident with these types of devices based primarily upon the complex manner in which the drive assemblies for sewing and punching operations are typically coupled and integrated. For instance, maintenance costs for these machines are increased since they are both more difficult to repair and since there are additional parts which are subject to wear and/or breakage. Moreover, the complex integration of both operations effectively limits the use of these machines to one function—that of sewing buttonholes. Relatedly, in order to possibly limit the increase in size necessitated by adding the punching assembly, machines of this type commonly perform punching and sewing operations in the same general area, that being the cylinder bed.

Although welting machines cannot be used for buttonhole sewing operations, such machines do typically perform a material cutting operation outside the cylinder bed. Welting machines are used to form welts for pockets on coats and other articles of clothing. In operation, a downwardly reciprocating knife and a sewing needle which are positioned in close proximity to each other in the cylinder bed are activated with the material appropriately positioned. As the material is advanced, the reciprocating knife cuts the material while the trailing needle sews the welt. Upwardly moving knives positioned outside of the cylinder bed place the two end cuts which define the ends of the pocket. Welting machines, however, are generally limited to a single function due to the manner in which the cutting and sewing operations are integrated. Moreover, although there is a material cutting operation performed outside the cylinder bed, no amount of material is removed since the upwardly reciprocating knife merely separates the fibers forming the material. Furthermore, there is no isolation between components used in the cutting and sewing operations.

One apparatus which addresses the need for a detachable punch-type assembly is U.S. Pat. No. 2,954,001 to Luxenburg, issued Sep. 27, 1960, which generally discloses an automatic eyelet attachment. The eyelet attachment, which includes a punch and presser foot, is positioned on a standard non-programmable sewing machine in place of the original presser foot. When sewing an eyelet, the punch penetrates and spreads fibers but does not actually remove any substantial amount of material. With the punch remaining in the material, the needle stitches a pattern therearound to form the eyelet. A disadvantage of a punch of this type is that the material tends to pucker when the punch is inserted, resulting in a product which may be aesthetically displeasing. Consequently, this puts a realistic limitation on the size of the eyelet that can be produced since larger punches of this type will only increase puckering. Moreover, the punching operation takes place in the sewing area or cylinder bed since the needle actually sews around the punch while in the material to form the eyelet. Furthermore, positioning this eyelet attachment on a programmable sewing machine which automatically advances the stitchable material by movement of the presser foot assembly would not appear to provide an operational system. More particularly, the presser foot assembly of a programmable sewing machine moves during sewing operations which would introduce a problem since the punch disclosed by Luxenburg, which is attached to the presser foot, remains in the material while the eyelet is sewn.

In some applications, it may be desirable to not only remove material portions of stitchable materials with a punching-type assembly, but to dispose of such removed portions as well. For instance, fibers or strands of material may be generated during the removal operations and such materials may collect and adversely affect the performance of the sewing machine. Moreover, in high production applications the removed portions, if not properly disposed of, may also present a number of problems.

A single action pneumatic cylinder punch is available from BIMBA which utilizes one type of a disposal system. The BIMBA cylinder is used to punch relatively heavy materials such as plastics. In this regard, the cutting head is hollow and is connected to a hollow shaft of the cylinder. The cylinder shaft is attached to the piston which has a small orifice therein which is aligned with the hollow portion of the cylinder shaft. Consequently, when air is applied to drive the piston, cylinder shaft, and cutting head in a downward direction, a comparatively small air flow simultaneously passes through the orifice in the piston and through the hollow portion of the shaft and cutting head such that the removed portion, when formed, will be displaced from the hollow cutting head. Therefore, air is actually applied to the portion to be punched prior to the removal of such portion and actually even prior to the cutting head contacting such portion.

In certain applications, the work piece has one or more guide or positioning holes therein to identify the specific location on the workpiece where the hole(s) should be made. In this case, it would be further desirable to also improve upon the accuracy of the placement of the desired hole in relation to its corresponding guide hole.

SUMMARY OF THE INVENTION

The present invention generally relates to an assembly which performs both material removal and sewing operations on a piece of stitchable material. In one aspect, the present invention relates to such an assembly which incorporates an alignment feature for material removal operations. More specifically, the assembly includes both sewing and material removal units. The material removal unit includes a material removal device which is displaced from the sewing needle of the sewing unit. In order properly align a piece of stitchable material having at least one guide hole therein (a single ply or multiple plies), a mechanical guide which interfaces with the guide hole(s) is provided with the material removal unit. This mechanical guide may be extendable and retractable through an aperture in a receiving table of the material removal unit such that the guide hole is properly aligned with the material removal device, and further such that the mechanical guide will not interfere with the operation of the material removal device. Consequently, the material removal device may produce a finished hole in the stitchable material by enlarging the size of the guide hole such that a pattern may be sewn about the finished hole for the desired application.

In another aspect, the present invention is an assembly which includes both sewing and material removal units. More specifically, the sewing unit includes a sewing needle which in part defines a sewing area. The sewing area more specifically includes that region below the throat plate or cylinder bed of the sewing unit which has components which interact with the sewing needle when performing sewing operations on one or more pieces of stitchable material. The assembly further includes at least one material removal unit which is displaced from the sewing area. Each such material removal unit is also isolated from the sewing area by appropriate structure. In order to automate the sewing and material removal operations, the sewing and material removal units are interconnected by a transport assembly, although the material removal unit is preferably separable from the sewing unit. Moreover, two material removal units may be positioned on opposite sides of the sewing unit to increase production capacity. Consequently, stitchable material may be alternately provided to the sewing unit from the two material removal units by a common transport assembly.

DETAILED DESCRIPTION

The kit assembly 12 in accordance with principles of the present invention will be described with reference to the accompanying drawings which illustrate its pertinent features. Although the kit assembly 12 may be used with standard sewing machines, it is particularly advantageous when used in combination with a programmable sewing machine 16 of the type illustrated in FIG. 1 to provide fully automated buttonhole sewing operations. Moreover, although button holes are primarily described herein, it will be appreciated that other material removal operations are also contemplated in the present invention.

Figure 1:
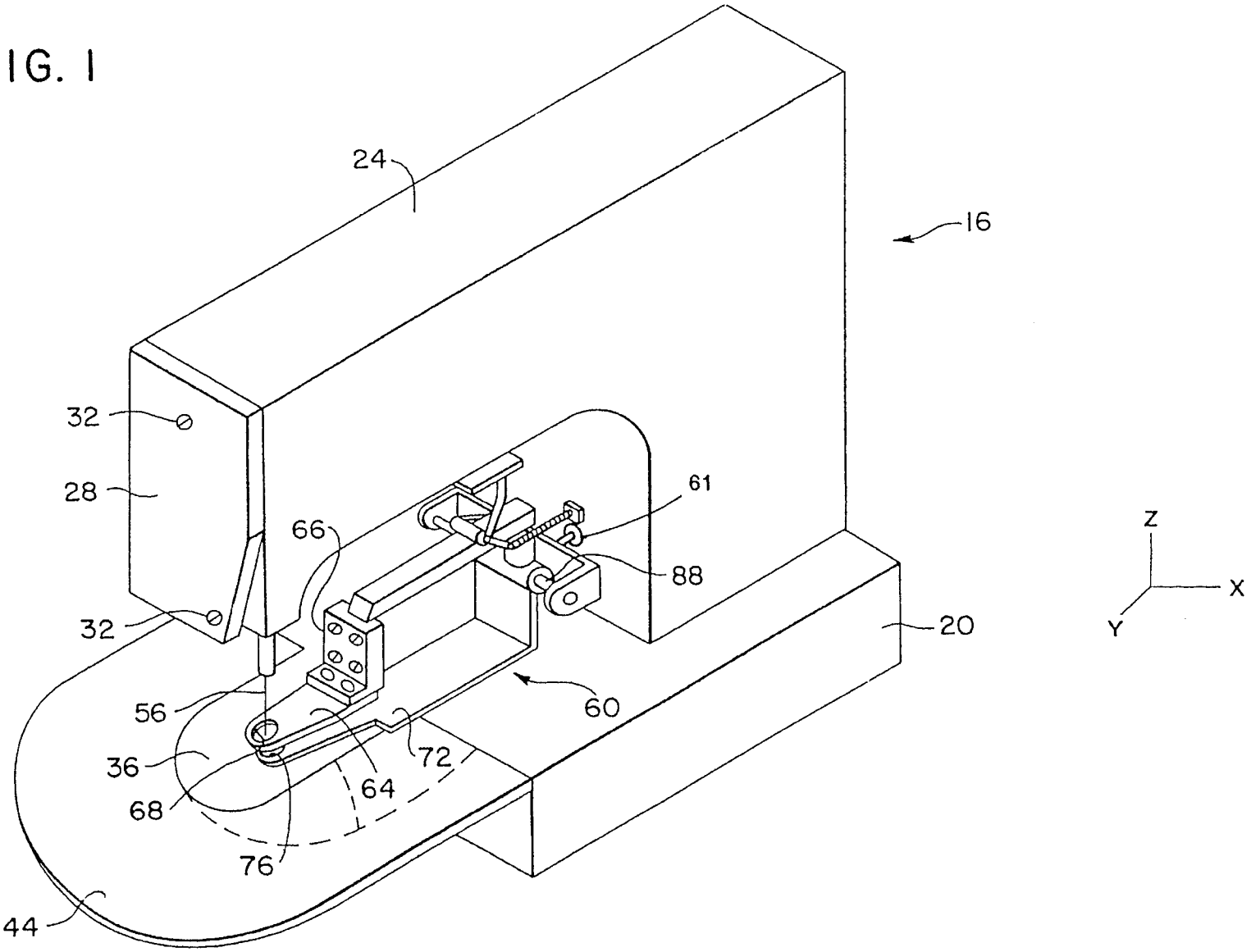
FIG. 1 is a perspective view of a known programmable sewing machine.

With reference primarily to FIG. 1, the programmable sewing machine 16 typically includes a base 20 which functions as a support, a head 24 which contains a portion of the sewing drive assembly 48 (FIG. 3), a detachable head cover 28 for accessing the sewing drive assembly 48 (FIG. 3), a cylinder bed or throat plate 36 which contains sewing components assembly 52 (FIGS. 3, 5, and 7) which interact with the sewing needle 56 to produce the desired stitch and which are positioned below the throat plate (e.g., a sewing area), a detachable support plate 44 which is positioned around the cylinder bed 36 to provide a surface for supporting the material to be stitched (FIG. 1), and a presser foot assembly 60 (FIG. 1) which moves the material to be stitched relative to the sewing needle 56 to produce the desired pattern. In order to produce this movement of the presser foot assembly 60, a programmable computer (not shown) governs control motors (not shown) which in turn direct the movement of the presser foot assembly 60 along and relative to the cylinder rod 88 (FIG. 2), along and relative to another cylinder rod (not shown) which is substantially perpendicular to the rod 88, and vertically via the illustrated linkages. Consequently, various stitching patterns may be stored in computer memory and accessed by the software to produce a preselected design.

Figure 2:
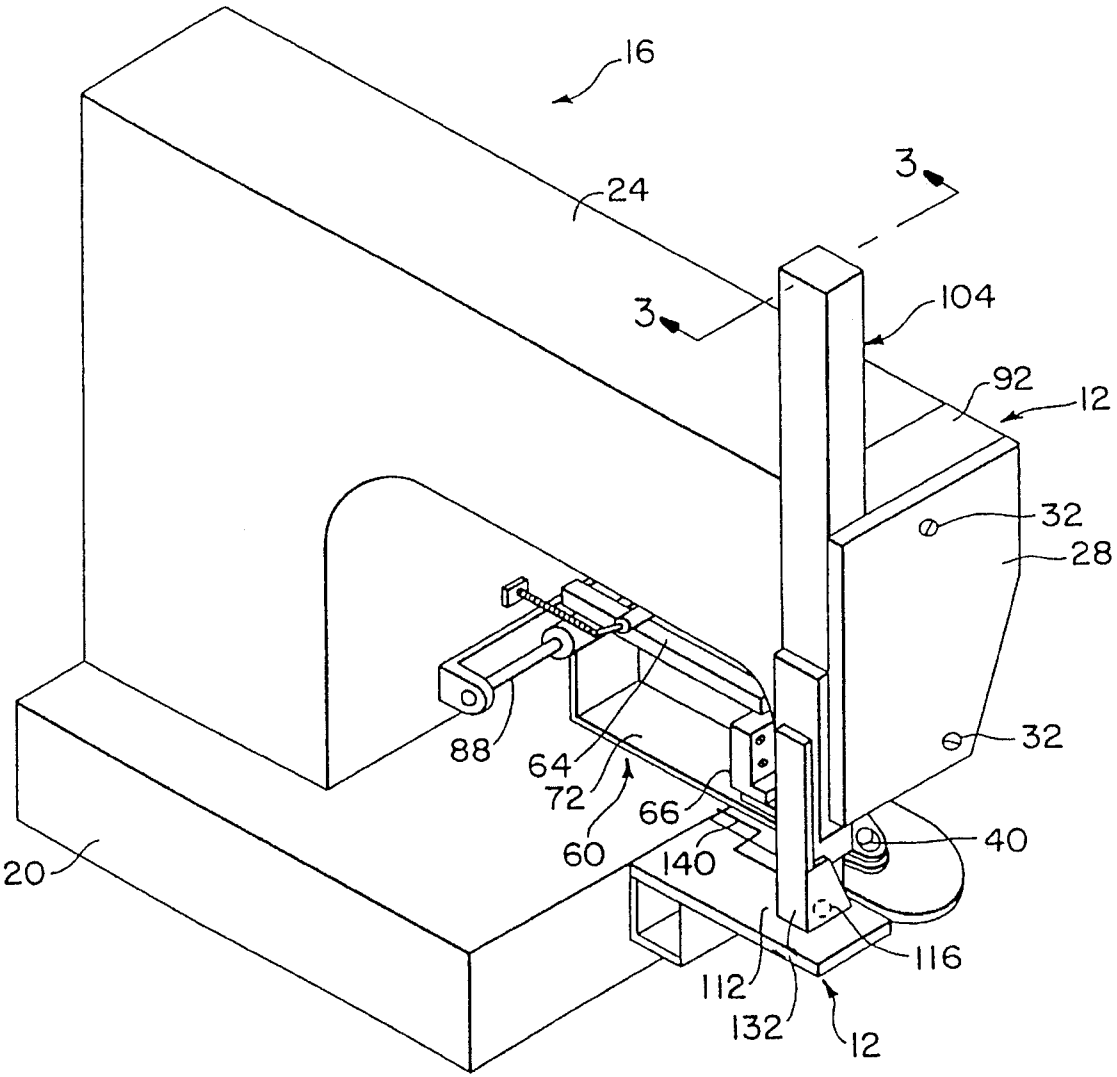
FIG. 2 is a perspective view of the programmable sewing machine of FIG. 1 incorporating a material removal unit to provide an assembly in accordance with principles of the present invention.

One embodiment of the kit assembly 12 is illustrated in FIG. 2 as it would be typically attached to a programmable sewing machine 16 of FIG. 1. The kit assembly 12 generally includes a support assembly 92 which is detachably connected to the end of the head 24 for containing the material removal device 120 (FIGS. 3–4), a driver 104 positioned above the head 24 which is coupled to and drives the material removal device 120, a table 112 which is detachably connected to the programmable sewing machine 16 substantially adjacent to and parallel with the cylinder bed 36, and a guard 132 which is pivotally attached to the support assembly 92 to protect against inadvertent dislodging of the material removal device 120 during sewing operations.

The support assembly 92 is configured to position the material removal device 120 contained therein so as to not interfere with the sewing drive assembly 48 or the sewing components assembly 52, including the sewing needle 56, of the programmable sewing machine 16. In one embodiment illustrated in FIGS. 3–4, a bore 96, positioned within the support assembly 92 and extending substantially vertically therethrough, guides the material removal device 120. This configuration reduces the deflection of the material removal device 120 when used on thicker and/or more resilient stitchable materials 144. In order to provide for a more frictionless engagement between the material removal device 120 and the bore 96, a sleeve bearing 100 of the type well known in the art is positioned therebetween.

The material removal device 120 generally includes a shaft 124, positioned within the bore 96 and coupled with the driver shaft 108 of the driver 104 by methods such as threaded engagement, and a cutting head 128 which removes stitchable material 144 to produce an opening of a desired contour. As can be appreciated, the cutting head 128 may be alternately configured to produce various contours of openings. Furthermore, the cutting head 128 may be a punch, cutting tool or any other suitable device for removing material. Although the shaft 124 and the cutting head 128 of the material removal device 120 may be integrally formed, the cutting head 128 in one embodiment is detachably connected to the shaft 124 by methods such as threaded engagement.

Figure 3:
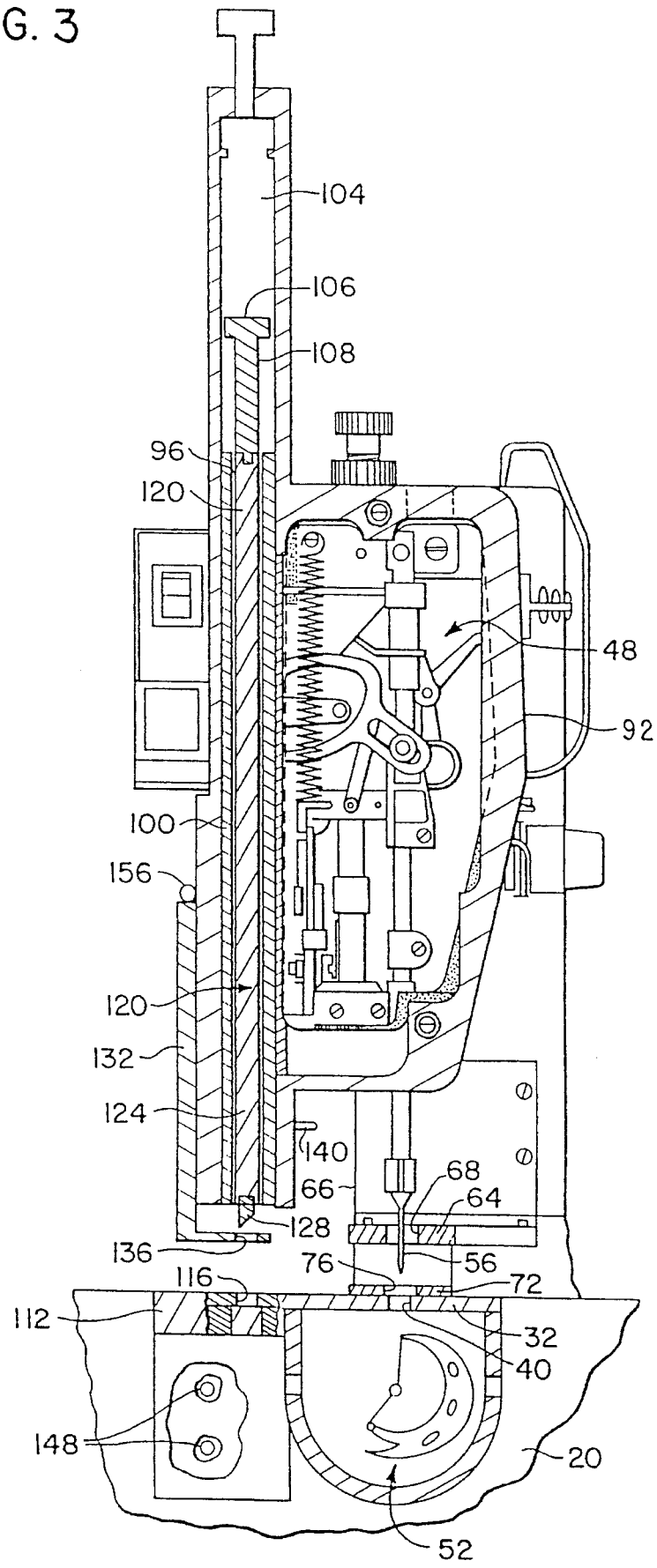
FIG. 3 is a cross-sectional view of the material removal unit of FIG. 2 taken along line 3—3.
Figure 4:
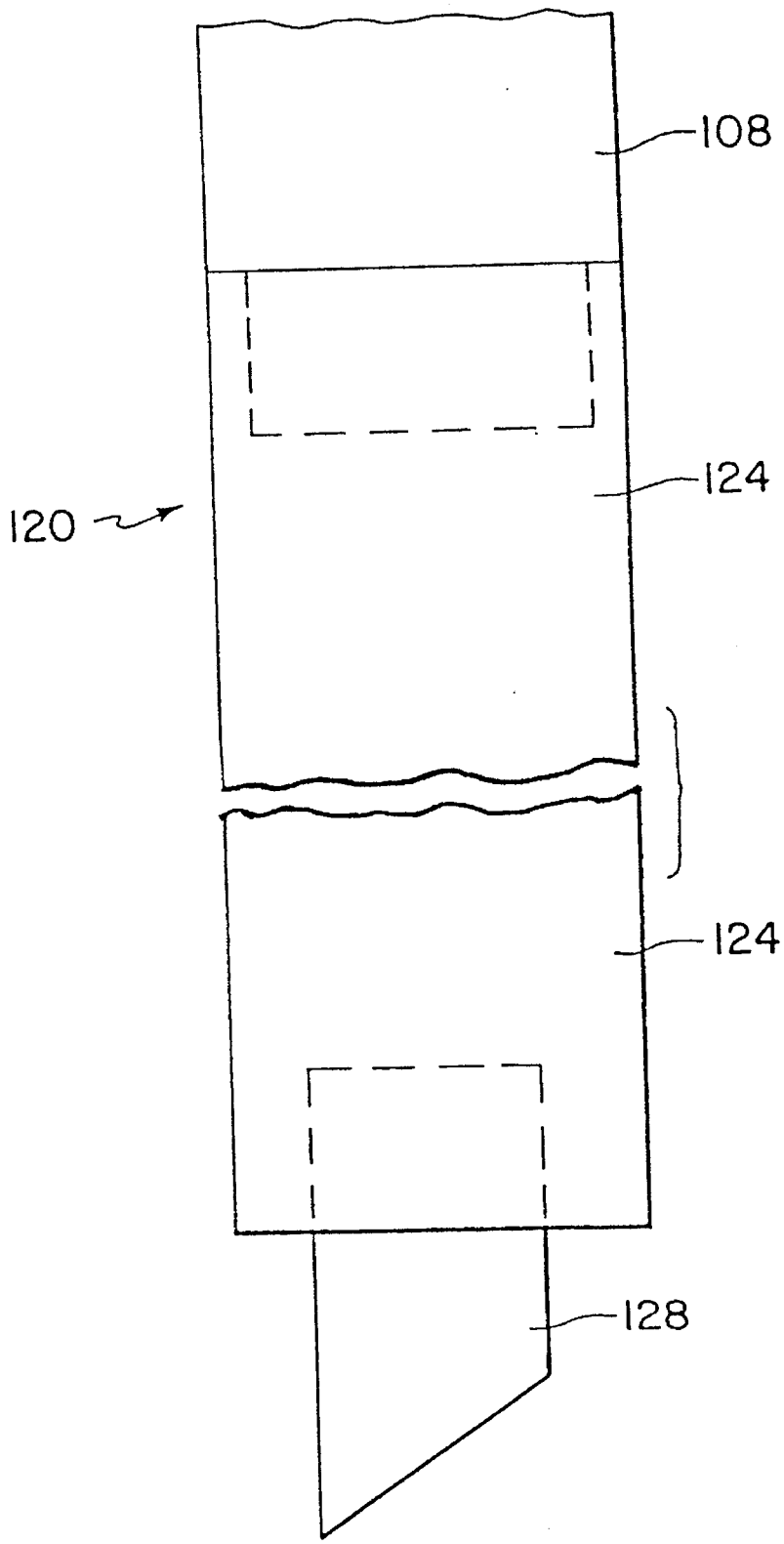
FIG. 4 is an enlarged view of one embodiment of a material removal device and its detachable connections.

The material removal device 120 is coupled with the driver 104 which supplies the necessary driving forces for material removal operations as best illustrated in FIGS. 3–4. Although numerous types of drivers 104 may be used and placed in a variety of positions, in one embodiment the driver is an air cylinder which is positioned above the head 24 and driven by an appropriate source (not shown). This positioning is advantageous in that a larger capacity driver 104, in this case an air cylinder having a driver piston 106 and driver shaft 108, may be used (i.e., more force application capacity) without interfering with the sewing drive assembly 48 or the sewing components assembly 52.

Figure 5:
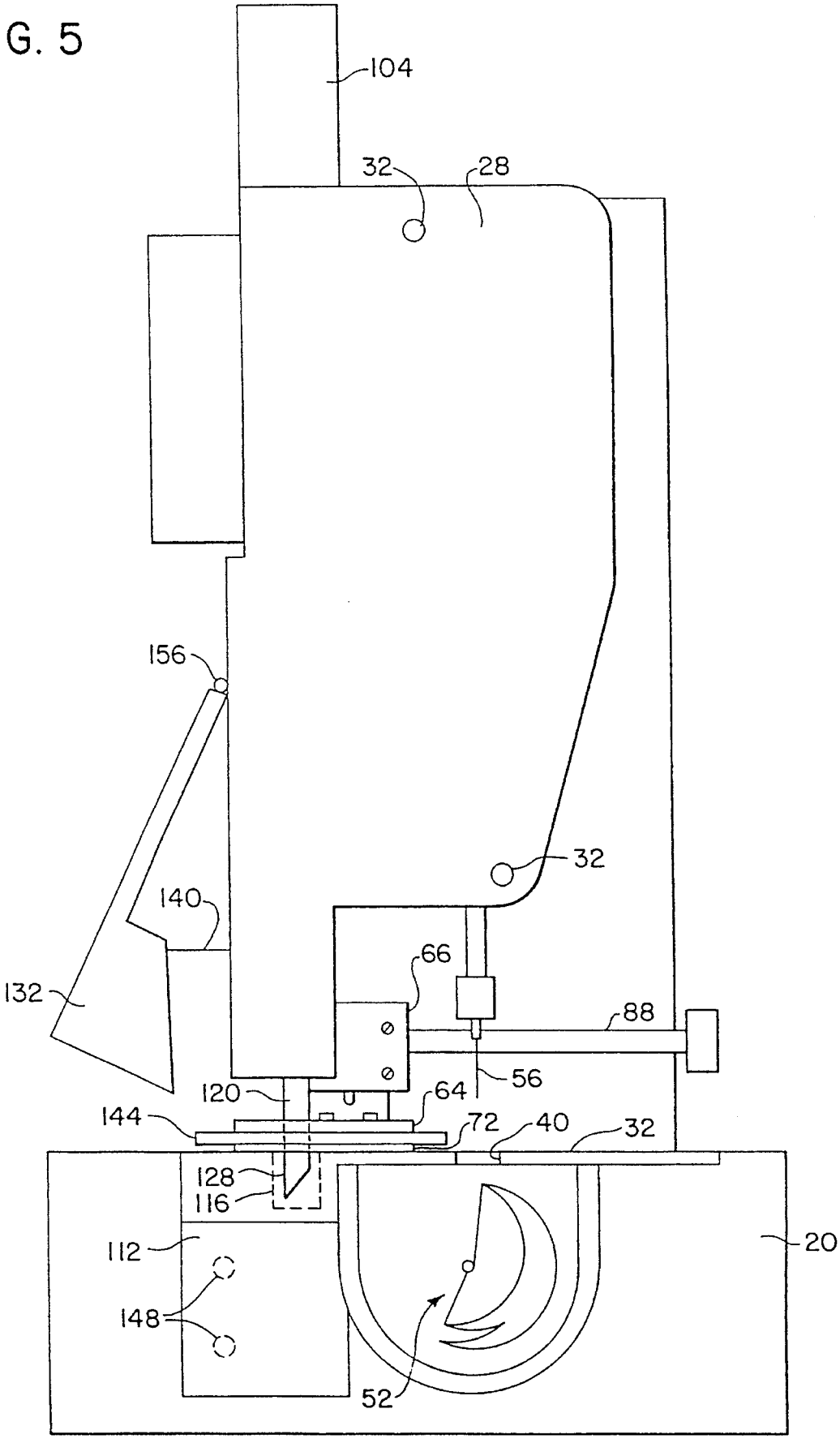
FIG. 5 is a front view of the assembly of FIG. 2, illustrating the positioning of the presser foot assembly and guard during material removal operations.
Figure 6:
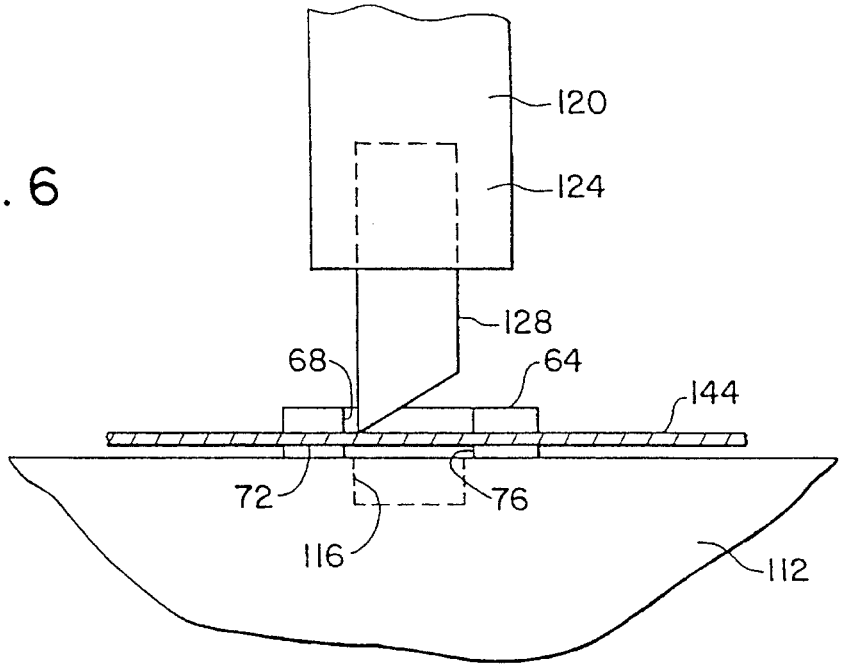
FIG. 6 is an enlarged front view of one embodiment of a material removal device during material removal operations.
Figure 8:
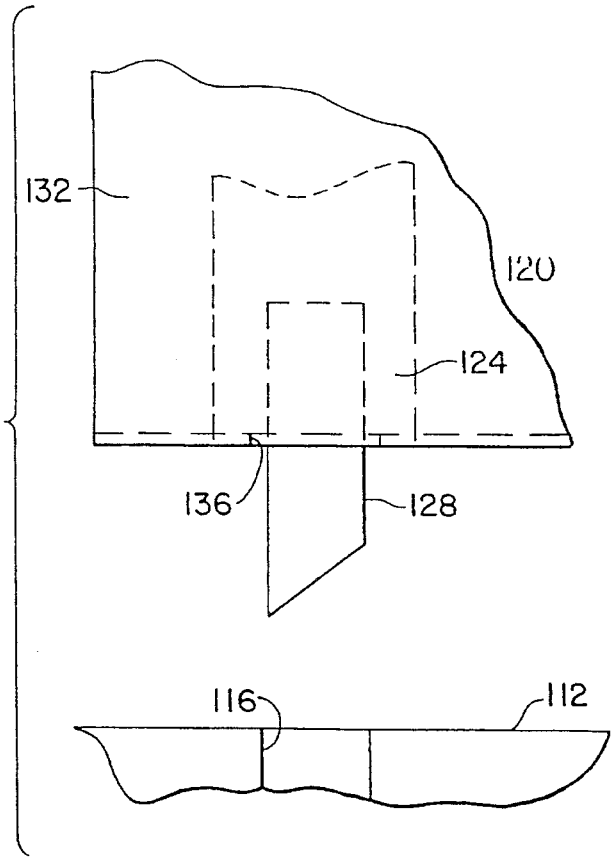
FIG. 8 is an enlarged front view illustrating the restricting of the downward movement of one embodiment of a material removal device by the guard.
Figure 7:
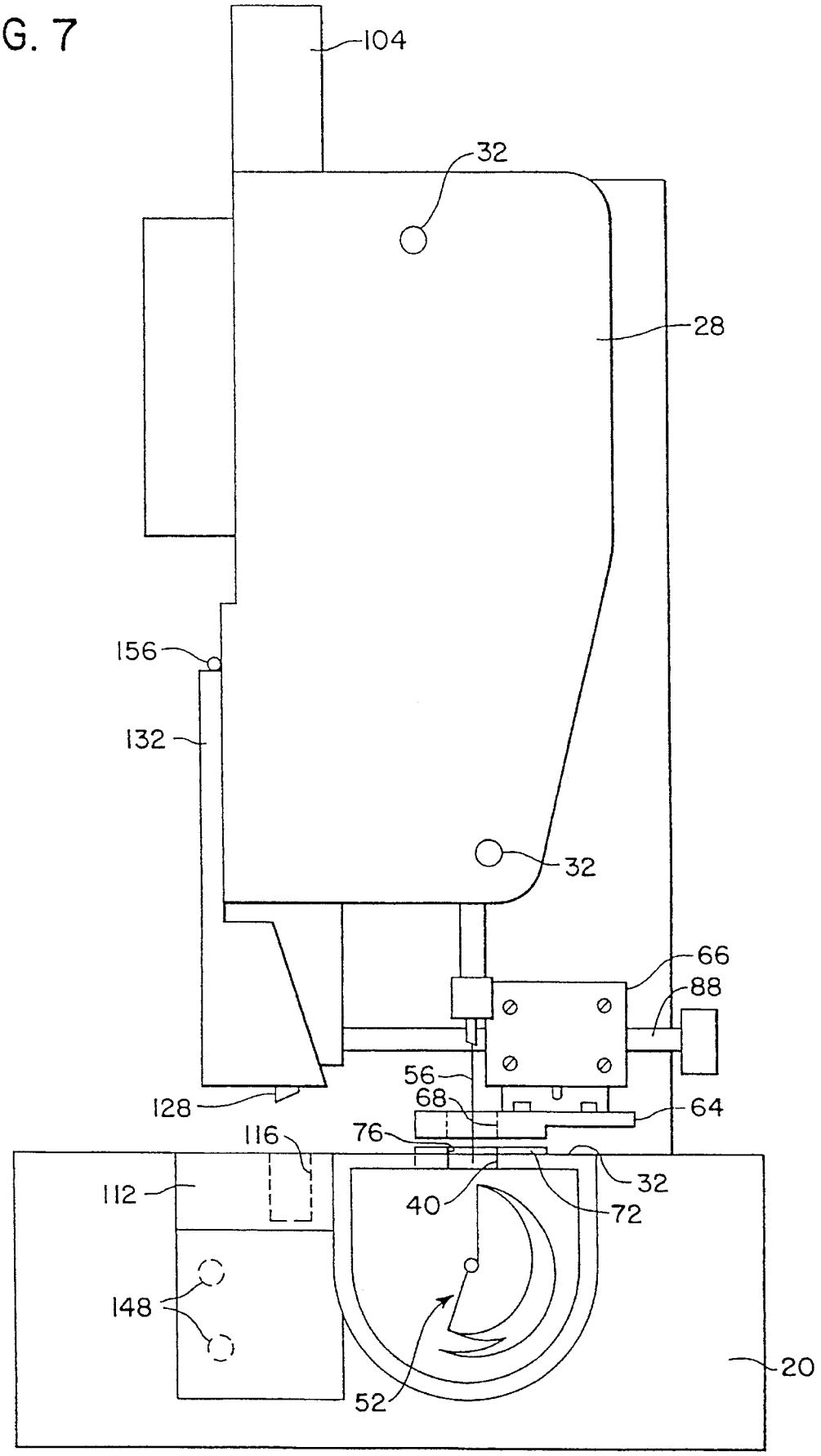
FIG. 7 is a front view of the assembly of FIG. 2, illustrating the positioning of the presser foot assembly and guard during sewing operations.

For purposes of enhancing operator safety during buttonhole sewing operations, a shelter or guard 132 is suitably attached to the support assembly 92, typically by a pivotal connection 156, as illustrated in FIGS. 3, 5, and 7. When the presser foot assembly 60 of the programmable sewing machine 16 is repositioned to the material removal area (FIG. 5) by the software and control motors (not shown), the bracket 66 of the presser foot assembly 60 engages with a guard wire 140 (FIGS. 2–3) attached to the guard 132 which pivots the guard 132 away from the area through which the material removal device 120 travels so that material removal operations may be performed. However, when the presser foot assembly 60 moves to the position illustrated in FIG. 7 to perform sewing operations, the guard 132 pivots to a position around and below which the material removal device 120 normally travels to restrict its downward movement in the event it is inadvertently deployed. In this regard, the cutting head 128 may pass through a guard hole 136 on the bottom of the guard 132 so that it is not damaged, as best illustrated in FIG. 8. However, the shaft 124 of the material removal device 120 is of a larger diameter than the guard hole 136 and thus inhibits further downward movement of the material removal device 120.

In order to provide a suitable surface for the material removal device 120 to engage with during material removal operations, the support plate 44 (FIG. 1) is replaced with a table 112 (FIG. 2) which is detachably connected to the programmable sewing machine 16 in a position which is substantially adjacent to and parallel with the cylinder bed 36. However, the table 112 is isolated from the sewing area below the cylinder bed 36 by the casting of the sewing machine 16. Positioned within the table 112, as best illustrated in FIGS. 3, 5, and 6–8, is a recessed receiver 116 in which the cutting head 128 of the material removal device 120 enters after having fully passed through the stitchable material 144. In order to enhance cutting of the stitchable material 144, the upper portion of the receiver 116 may be contoured to provide a cutting edge.

An advantage of the structural configuration of the kit assembly 12 presented herein is that it is positioned a sufficient distance from the sewing drive assembly 48 and the sewing components assembly 52, including the sewing needle 56, so as to not interfere with their normal operations. Nonetheless, the kit assembly 12 may be positioned sufficiently close to the sewing area defined by the cylinder bed 36, more particularly the sewing needle 56 and the cylinder bed hole 40, so as to not adversely affect the overall speed of the material removal and sewing operations. In this regard and for a buttonhole application, preferably the distance between the centers of the recessed receiver 116 and the cylinder bed hole 40 will be about five (5) inches or less.

Installation of the kit assembly 12 typically requires little if any modification of the programmable sewing machine 16. When used with a programmable sewing machine of the type illustrated in FIG. 1, the head cover 28 is detached by removing the head cover screws 32 and the support assembly 92, which preferably is configured to substantially follow the contour of the end of the head 24, is mounted to the head 24. The head cover 28 may then be positioned on the end of the support assembly 92 and the head cover screws 32, or appropriate substitutes, may be positioned through the holes in the head cover 28, the support assembly 92, and programmable sewing machine 16. In order to complete the installation, the support plate 44 is removed and the table 112 is positioned substantially adjacent to and parallel with the cylinder bed 36 and is attached to the programmable sewing machine 16 in an appropriate manner by, for instance, two fasteners 148 (FIG. 3). Although material removal operations may be manually controlled, preferably the kit assembly 12 is integrated with the software of the programmable sewing machine 16 such that fully automated operations will be provided.

When the kit assembly 12 has been properly integrated with the controlling software for the programmable sewing machine 16 and material removal operations are to be initiated, the stitchable material is placed in the presser foot assembly 60 of the programmable sewing machine 16 between the upper presser foot 64 and the lower presser foot 72. Thereafter, the presser foot assembly 60 is engaged as is known in the art to firmly secure the stitchable material 144. Then the presser foot assembly 60, together with the stitchable material 144, is moved to the desired position for material removal operations as generally illustrated in FIG. 5. As the presser foot assembly 60 is repositioned over the table 112, the bracket 66 engages the guard wire 140 attached to the punch guard 132 such that it pivots away from the support assembly 92 into the position illustrated in FIG. 5.

Once the desired sewing pattern has been selected, the software sends a signal to the driver 104 to activate the material removal device 120. Consequently, the material removal device 120 is driven down through the upper and lower presser foot holes 68, 76, respectively, and the stitchable material 144 until the cutting head 128 enters the receiver 116 in the table 112. After the desired portion of the stitchable material 144 has been removed, the software directs the controllers (not shown) to retract the driver shaft 108 of the driver 104 and thus the material removal device 120.

After the material removal operations are completed, the presser foot assembly 60, as directed by the software and through use of the control motors (not shown), is moved laterally toward the cylinder bed 36 along the cylinder rod 88 to align the opening in the stitchable material 144 with the sewing needle 56. During this movement of the presser foot assembly 60, the guard 132 moves into the position illustrated in FIG. 7 since the bracket 66 of the presser foot assembly 60 no longer exerts a force on the guard wire 140. When the stitchable material 144 is properly positioned relative to the sewing needle 56, the software directs the sewing drive assembly 48 to begin sewing operations through the sewing components assembly 52, including the sewing needle 56, as is well known in the art. Consequently, a pattern is sewn around and in the opening in the desired manner.

Once sewing operations are completed, the software directs the controllers (not shown) to move the presser foot assembly 60, together with the stitchable material 144, in a lateral direction along the cylinder rod 88 from the position illustrated in FIG. 7 back to the initial position generally illustrated in FIG. 5. When this movement is initiated, the sewing needle 56 is in an upward position as illustrated in FIG. 5 so as to not catch on the upper presser foot 64. Moreover, as the presser foot assembly 60 is repositioned over the table 112, the bracket 66 engages the guard wire 140 attached to the guard 132 such that it pivots away from the support assembly 92 into the position illustrated in FIG. 5 to allow material removal operations to be performed. Thereafter, the cycle of material removal and sewing operations may be repeated in the above-described manner.

Although the material removal and sewing operations has been described as such, it can be appreciated that the sequence may be reversed. In this regard, the sewing operations would first produce the desired stitching pattern on the stitchable material 144. Thereafter, material removal operations would be performed to remove portions of the stitchable material 144 inside of the area defined by the stitching pattern. Although the same general end product is obtained by both sequences, performing material removal operations after sewing operations results in a hole or opening not having a stitched border therearound, thereby exposing some fibers of the stitchable material 144.

As can be appreciated by those skilled in the art, after material removal and sewing operations are completed, the punch kit assembly 12 of may be disabled or entirely removed such that the programmable sewing machine 16 may be used for alternate functions. This is desirable since most programmable sewing machines are used for industrial applications and thus are quite expensive. Moreover, essentially no structural modification is required of the programmable sewing machine 16 to use the kit assembly 12 so that performance of the programmable sewing machine 16 is not adversely affected. Furthermore, material removal operations may take place sufficiently close to the sewing area in the case of the kit assembly 12 such that the overall speed of material removal and sewing operations is not adversely affected.

Figure 14:
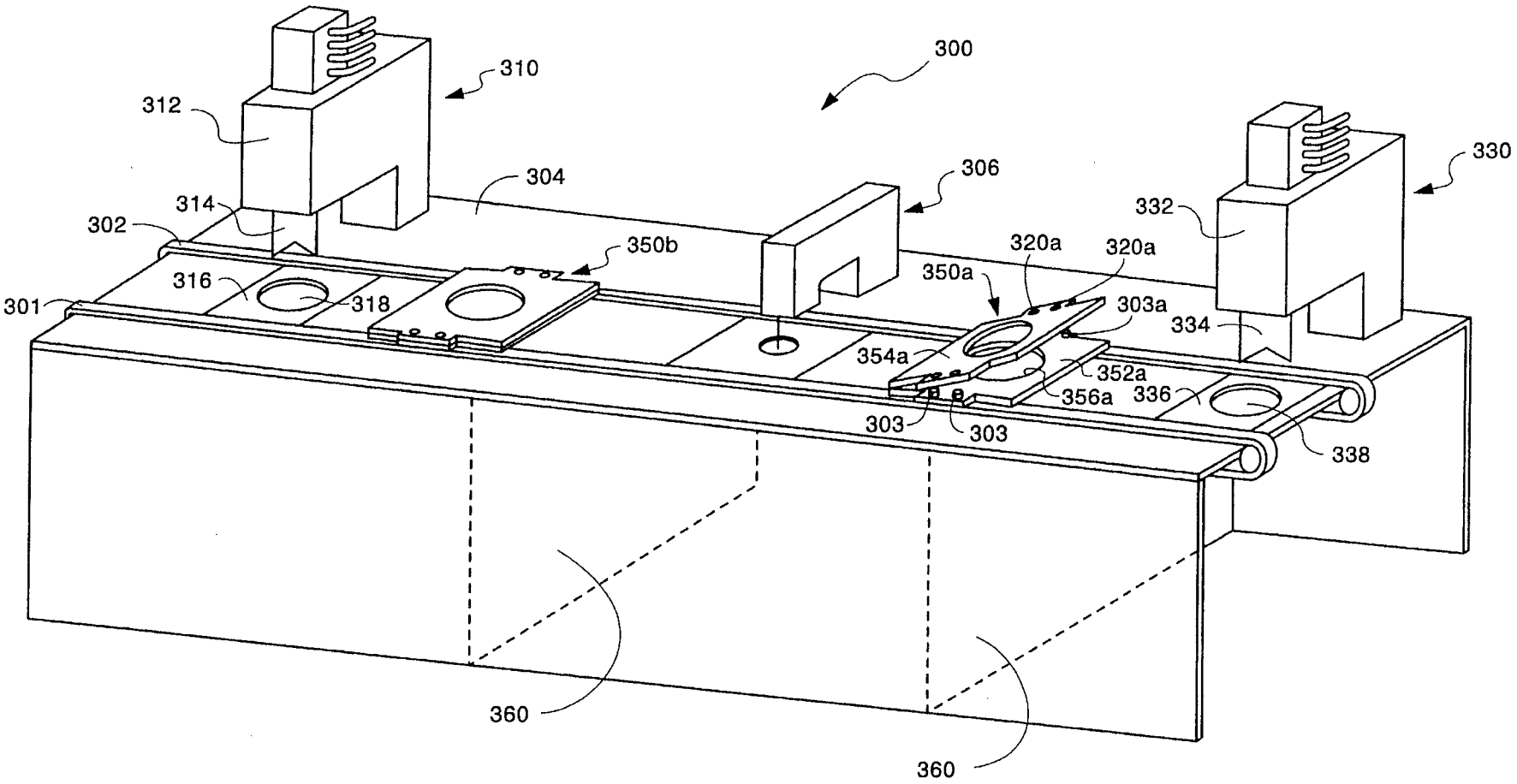
FIG. 14 is a perspective view of another embodiment of a sewing and material removal assembly in accordance with principles of the present invention.
Figure 15:
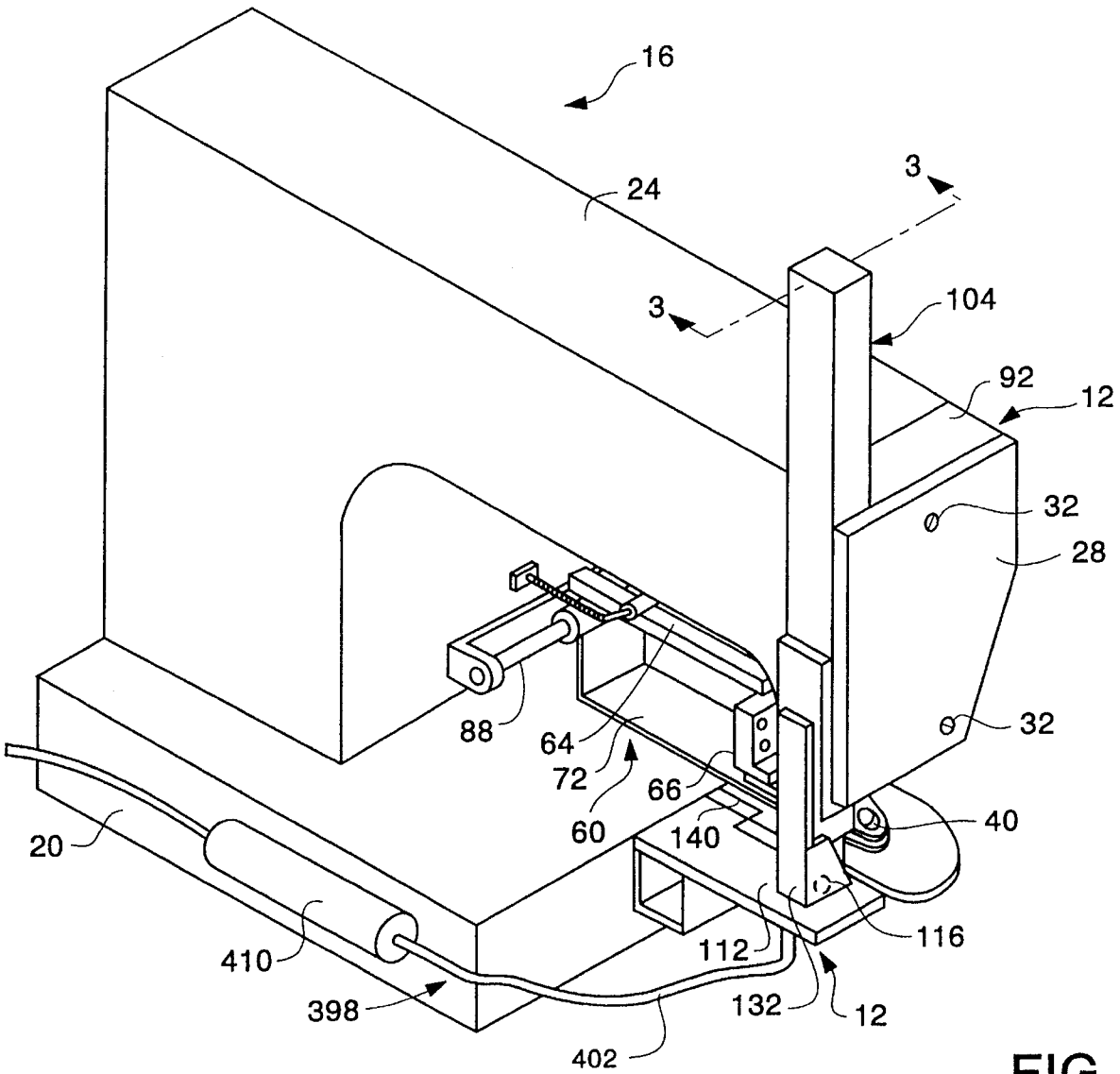
FIG. 15 is a perspective view of the assembly of FIG. 2 incorporating an alignment assembly in accordance with further principles of the present invention.

Principles of the present invention are also embodied within the material removal and sewing assembly 300 illustrated in FIG. 14. Generally, the assembly 300 includes a first material removal unit 310 and a second material removal unit 330 which are laterally displaced on opposing sides of a sewing unit 306. The sewing unit 306 provides for sewing operations on one or more pieces of stitchable material (e.g., one or more overlapping plies), whereas each of the material removal units 310, 330 provide for material removal operations on such stitchable material. A transport assembly belt 302 integrates sewing and material removal operations by moving pallet clamps **350*a*, 350*b* along platform 304 between sewing unit 306 and material removal units 310, 330. Consequently, the transport assembly 302 also interconnects the sewing unit 306 with each of the material removal units 310, 330**.

As in the case of the kit assembly 12 mounted on the programmable sewing machine 16, the material removal operations are again isolated from the sewing area. This may be provided by barriers 360 disposed on opposite sides of the sewing unit 306. Alternatively, the sewing unit 306 and each of the material removal units 310, 330 may each be contained within separate housings (not shown). In this case, there would be three physically separate machines (i.e., a sewing unit and two material removal units) which would then be appropriately interconnected to provide an assembly 300 with an automated integration of sewing and material removal operations. For instance, the platform 304 could be positioned on the upper surface of these separate machines and appropriately attached thereto, and the platform 304 could incorporate the transport assembly 302.

As noted, the assembly 300 has the sewing unit 306, although more could be incorporated if desired to further enhance production capabilities. Nonetheless, the sewing unit 306 is preferably a programmable sewing machine analogous to the machine discussed above, and thus is able to provide automated sewing operations for the assembly 300. Moreover, each material removal unit 310, 330 is principally similar to the kit assembly 12 discussed above for providing automated material removal operations for the assembly 300. However, the spacing between the sewing unit 306 and each of the material removal units 310, 330 is increased over that disclosed above with regard to the kit assembly 12 to accommodate, for instance, for different applications.

The first and second material removal units 310, 330, respectively, include a head 312, 332, respectively, which houses a material removal device or punch 314, 334, respectively, for removing portions of stitchable material from a given work-piece in a predetermined pattern. Each punch 314, 334 is preferably threadedly engaged with the respective material removal unit 310, 330 or otherwise detachable therefrom to allow punches of different sizes and geometric configurations to be used with the material removal units 310, 330. It will be appreciated that a plurality of punches may be utilized by each material removal unit 310, 330 (not shown), for instance, to punch a predetermined pattern of a plurality of holes in one or more pieces of stitchable material. Regardless if one or more punches are used, such may be driven in the above-described manner, either individually or via mounting on a common structure which is then appropriately driven.

Each material device 310, 330 also includes a removable punch table 316, 336 having a bore 318, 338 positioned beneath punch 314, 334 to receive a portion of punch 314, 334 during a punching operation. The diameter of each bore 318, 338 is preferably slightly larger than the outer diameter of punch 314, 334 to allow a portion of the associated punch 314, 334 to pass through the bore 318, 338 during a material removal operation. As will be appreciated, punch tables 316, 336 having bores of different sizes and configurations may be required to accommodate punches 314, 334 of different sizes and shapes. Moreover and in the case where multiple punches are used to produce a predetermined pattern of a plurality of holes in one or more pieces of stitchable material, multiple bores may be utilized with one being aligned with each associated punch.

The transport assembly 302 transfers the stitchable material between the material removal units 310, 330 and the sewing unit 306. The transport assembly 302 includes a conveyor belt 301 and pallet clamps 350. Each pallet clamp 350 includes a lower member 352 and an upper member 354 for retaining one or more overlapping pieces of stitchable material therebetween. In order to appropriately interconnect the conveyor belt 301 and the pallet clamps 350, the conveyor belt 301 includes pegs 303 which pass through positioning holes 320 in the upper members 352 and lower members 354 of the pallet clamps 350.

The pallet clamps 350 retain the one or more pieces of stitchable material during material removal and sewing operations, and also allow for an automated transfer of such materials between the sewing unit 306 and the material removal units 310, 330. In this regard, each pallet clamp 350 further includes a bore 356. This bore 356 allows a punch(es) from one of the material removal units 310, 330 to pass through the pallet clamp 350 and thus perform material removal operations on the one or more pieces of stitchable material therein, as well as allows the sewing needle of the sewing unit 306 to perform sewing operations on such one or more pieces of stitchable material while positioned in the pallet clamp 350. As will be appreciated, pallet clamps 350 having differently sized and shaped bores may be used with punches of different sizes and shapes.

The sewing and material removal assembly 300 provides for a desired automation of sewing and material removal operations and with an increased production capacity. That is, the sewing unit 306 alternately receives materials from the material removal units 310, 330 for performing sewing operations thereon. One such sequence which could be used is as follows. Initially, with the conveyor belt 301 in the position illustrated in FIG. 14 and while in a stationary condition, the operator (not shown) unloads the one or more pieces of stitchable material from the pallet clamp **350*a* after sewing and material removal operations have been performed thereon. The pallet clamp 350*b* has one or more pieces of stitchable material positioned thereon (not shown) and has already had material removal operations performed thereon at the material removal unit 310. The operator places one more pieces of stitchable material in the pallet clamp 350*a*. More specifically, one or more pieces of stitchable material are positioned on the lower member 352*a* of the pallet clamp 350*a* and its upper member 354*a* is then closed over the lower member 352*a* to secure the one or more pieces of stitchable material in place. Thereafter, the operator may initiate a cycle by providing a signal to the assembly 300 which causes the conveyor belt 301 to moves the pallet clamp 350*a* under the material removal unit 330 and to simultaneously move the pallet clamp 350*b* under the sewing unit 306. After the material removal device 330 and sewing machine 306 have completed their respective operations on the materials in the pallet clamps 350*a*, 350*b*, respectively, the controlling software moves the conveyor belt 301 back to the position illustrated in FIG. 14 at which time the one or more pieces of stitchable material from the pallet clamp 350*b* are removed therefrom (having one or more holes formed therein with an associated sewing pattern), and one or more pieces of new stitchable material are loaded in the pallet clamp 350*b* in the above-described manner. The pallet clamp 350*a* remains in this position with its stitchable material being retained therein. The above sequence is then repeated, namely the stitchable material in the pallet clamp 350*a* and with one or more holes formed thereon is provided to the sewing unit 306 for the performance of sewing operations thereon, while the pallet clamp 350*b* is disposed in alignment with the material removal unit 310 for performance of material removal operations thereon. Although the sewing and material removal sequence has been described as such, those skilled in the art will appreciate that the sequence and/or the timing thereof may be modified. For instance, once the cycle is initiated the conveyor belt 301 may stall for a predetermined period of time in the position illustrated in FIG. 14 to allow a given pallet clamp 350 to be unloaded with a finished product and reloaded with new stitchable materials. Moreover, although the assembly 300 has been described with regard to two material units 310, 330 which alternately feed a common sewing unit 306**, such is not required for certain principles of the present invention.

Figure 10:
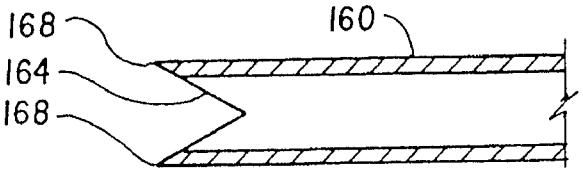
FIG. 10 is a cross-sectional view of the material removal device of FIG. 9 taken along line 10—10.
Figure 9:
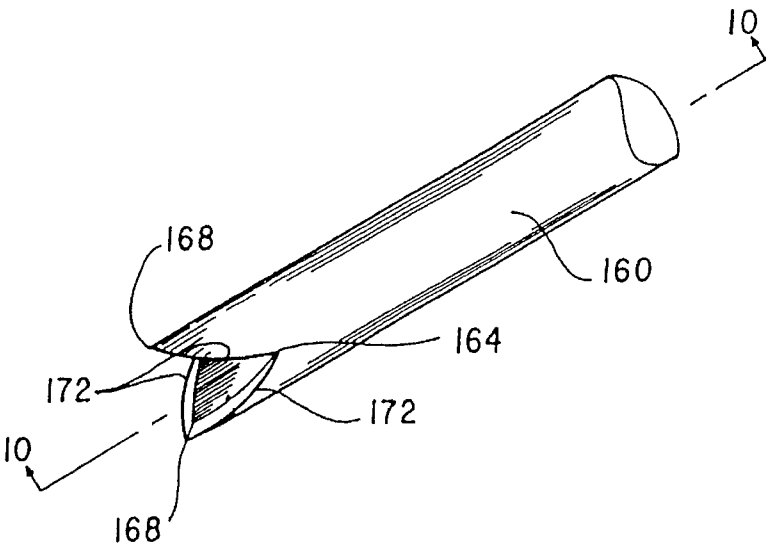
FIG. 9 is a perspective view of one embodiment of a hollow material removal device.

Another embodiment of the present invention is directed toward efficiently removing material portions of a stitchable material and then carrying away and preferably disposing of such removed portions. As can be appreciated, when removing material portions of heavy-duty stitchable materials (e.g., multiple plies, thicker materials, resilient materials), an increased amount of force may be required to drive the material removal device 120 discussed above through such materials, particularly if the portion of the cutting head 128 of the material removal device 120 which interacts with the stitchable material is a substantially continuous planar surface (e.g., a blunt-nosed configuration). Consequently, the material removal device 160 of FIGS. 9–10 utilizes a hollow configuration which reduces the area of contact between the stitchable material and the material removal device 160 to effectively an edge, thereby providing for an enhanced "cutting" action and more efficient penetration.

The material removal device 160 utilizes a hollow tubular configuration and V-shaped portions 164 are positioned on opposite sides of the device 160 such that there are two points 168 which first engage the stitchable material for a more effective initial separation thereof. Moreover, the V-shaped portions 164 define four cutting edges 172 (only three shown) which taper outwardly from the points 168 to further enhance the separation of the stitchable material as the material removal device 160 is driven downwardly through the stitchable material. Although the material removal device 160 may be formed from a variety of materials, preferably the device 160 is metal which improves its durability and allows for the provision of sharp cutting edges 172. Moreover, as can be appreciated the diameter and/or end configuration of the hollow material removal device 160 may be varied depending upon criteria such as the given applications requirements. For instance, the material removal device 160 is substantially circular with an outside diameter ranging from about ⅛ inch to about ¼ inch.

Figure 11:
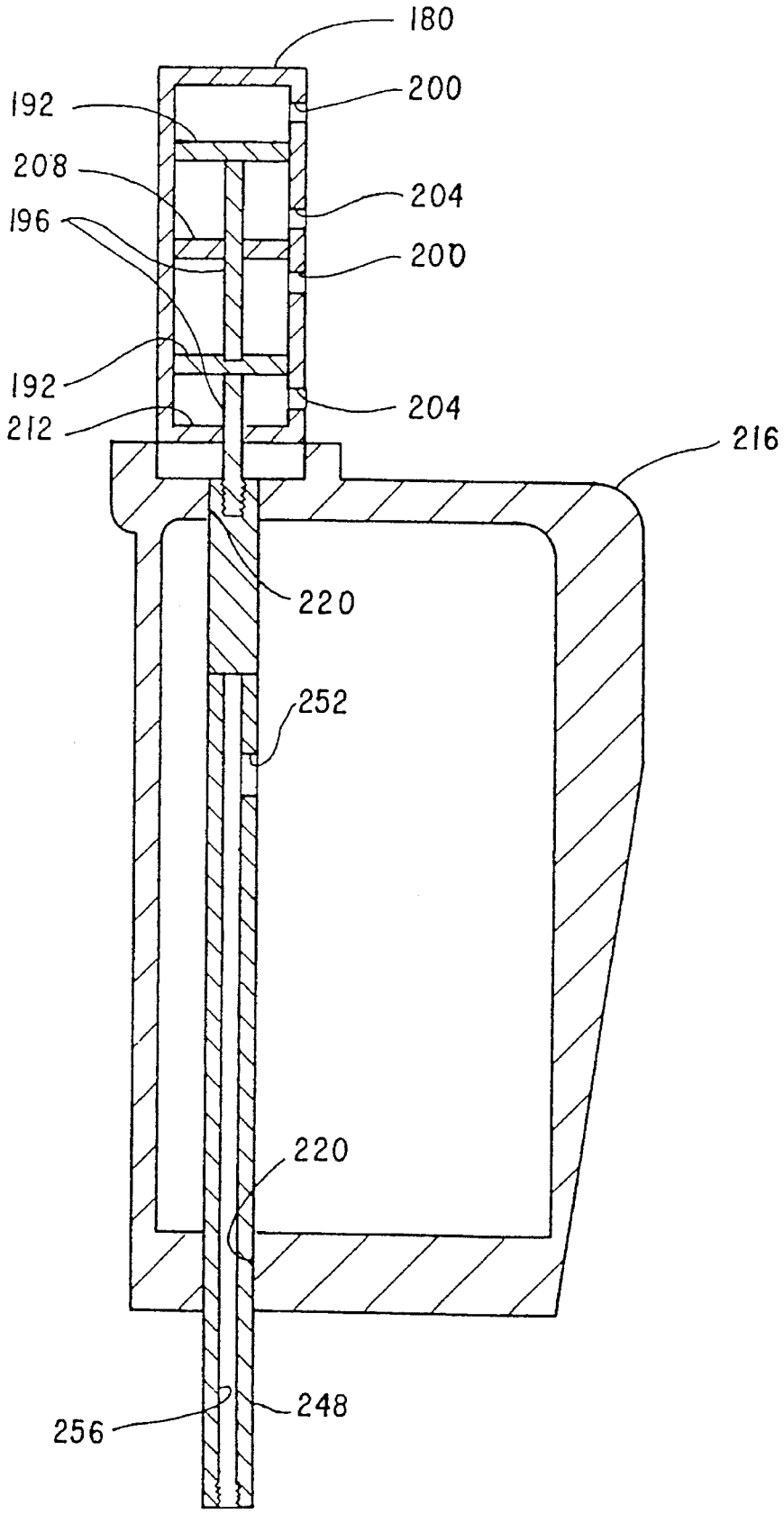
FIG. 11 is a cross-sectional view of one embodiment of a drive assembly for material removal operations which utilizes a system for carrying away the removed portions.

The material removal device 160 is driven downwardly into engagement with the stitchable material to remove material portions thereof. Although a number of drive mechanisms for performing this function would be appropriate, FIG. 11 illustrates a drive assembly 180 which is particularly suitable based upon the portion disposal system 244 which is preferably used with the material removal device 160 as will be discussed below.

The drive assembly 180 is appropriately mounted on a support assembly 216. The support assembly 216 preferably approximates the contour of an end portion of the head 24 of the programmable sewing machine 16 (FIG. 1) such that the assembly 216 may be attached thereto in a manner similar to support assembly 92 discussed above. The drive assembly 180 utilizes two chambers 188 in a "series" configuration (i.e., stacked), the chambers 188 being separated by a partition 208. Each chamber 188 has a piston 192 slidably positioned therein with a piston shaft 196 being attached to each of the pistons 192 to transfer the motion of such pistons 192 to a desired object. In this regard, the uppermost piston shaft 196 extends through the partition 208 and engages the lowermost piston 192 in an appropriate manner. The piston shaft 196 of the lowermost piston 192 extends through the bottom 212 of the drive assembly 180 to engage the connecting shaft 248 which is used to transfer the motion of the pistons 192 to the material removal device 160. Consequently, the pistons 192 and thus the piston shafts 196 are capable of simultaneous movement to govern movement of the material removal device 160.

The drive assembly 180 is a dual action configuration in that each chamber 188 has an upper and lower port 200, 204. Consequently, conduits (not shown) may be connected to the upper and lower ports 200, 204 to supply a medium to alternately act against the opposite sides of the pistons 192 at the appropriate times and thus achieve the desired downward and upward motion for the material removal device 160. Although various mediums may be employed, preferably a pneumatic system (not shown) is utilized for driving the pistons 192 through this downward/upward cyclic motion.

The simultaneous movement of the pistons 192 is transferred to the connecting shaft 248 which has the material removal device 160 attached at its opposite end. The lowermost piston shaft 196 may engage the upper end of the shaft 248 by various appropriate manners, such as threaded engagement. The material removal device 160 may also be similarly attached to the lower end of the shaft 248. In order to stabilize the connecting shaft 248 and limit the deflection thereof when engaged in material removal operations, the shaft 248 and/or the lowermost piston shaft 192 pass through a bore 220 in the upper and lower portions of the support assembly 216. Although not shown, a sleeve bearing may again be utilized in the bores 220 to reduce the frictional engagement of the shaft 248 and/or piston shaft 196 with the support assembly 216.

Based upon the hollow configuration of the material removal device 160 and the downward direction in which the device 160 moves when removing portions of stitchable material, there may be a tendency for the removed portions to move up within the hollow interior of the device 160. After an extended period of operation, the potential for a plurality of such removed portions filling or becoming jammed within the entire interior portion of the material removal device 160 increases, which could adversely affect material removal operations. In order to reduce this potential, the material removal device 160 is preferably used in combination with the portion disposal system 244 illustrated in FIGS. 11 and 12.

The portion disposal system 244 carries away the removed portions of stitchable material. A portion of the disposal system 244 is incorporated within the drive assembly 180 discussed above in that the connecting shaft 248, which is again used to transfer the motion of the pistons 192 to the material removal device 160, has an inner cavity 256 which extends along a portion of the length of the shaft 248 and which is in communication with the hollow interior of the material removal device 160. A port 252 extends through a wall of the shaft 248 in an appropriate location to interact with this cavity 256. Consequently, an appropriate conduit (not shown) may be positioned within the port 252 such that an appropriate medium may be forced through the inner cavity 256 to discharge the removed material portions from the end of the material removal device 160 at the appropriate time. As can be appreciated, such removed portions could also be withdrawn from the interior of the hollow material removal device 160 by a suction-type action.

Figure 12:
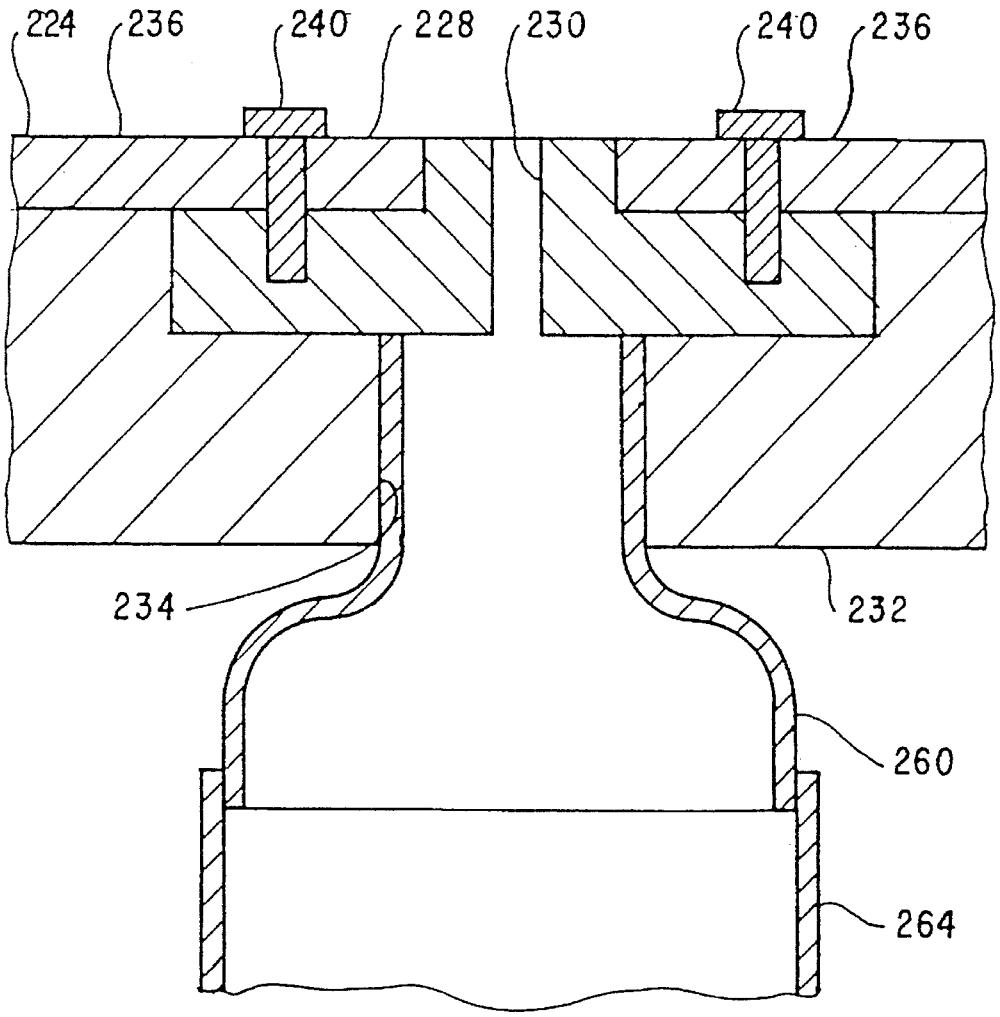
FIG. 12 is one embodiment of a table for interacting with the material removal device and which incorporates a part of a portion disposal system.

In order to allow for the collection of the removed portions of stitchable material, the above-described table 112 and receiver 116 are modified. FIG. 12 illustrates the pertinent portions of the table 224 which accommodates for use of the portion disposal system 244, the remainder of the table 224 being substantially similar to the table 112 described above for similar attachment to the programmable sewing machine 16 (e.g., such that the table 224 is substantially parallel with and adjacent to the cylinder bed 36). The table 224 includes an insert 228 with a bore 230 therethrough such that the shaft 248 and the attached material removal device 160 may travel within the bore 230 during material removal operations. The insert 228 is seated within a base 232 and is secured therein by positioning plates 236 over portions of the insert 228 and by engaging the plates 236, insert 228, and base 232 with screws 240.

A bore 234 within the base 232 is substantially aligned with the bore 230 in the insert 228. A bell-shaped adapter 260 is positioned and secured within the bore 234, such as by threaded engagement, in order to interconnect the bore 234 and a conduit 264 attached to the adapter 260. The removed portions of stitchable material may therefore ultimately flow through the conduit 264 and be appropriately deposited. In this regard, the opposite end of the conduit 264 is preferably connected to an appropriate receptacle (not shown) which will contain the removed portions of stitchable material. Based upon the preferred medium used by the portion disposal system 244, namely forced air, this receptacle is preferably formed from a material which will allow the medium to pass therethrough but which will retain the portions of stitchable materials, such as a cotton receptacle.

In summarizing the operation of the material removal operations when the material removal device 160 is used in combination with the portion disposal system 244, the pistons 192 of the drive assembly 180 will be in their uppermost positions within the respective chambers 188 prior to initiation of the removal operations. When the stitchable material has been properly positioned for removal operations in the above-described manner, the medium, again preferably air, is provided through the upper ports 200 of the chambers 188 to drive the pistons 192 in a downward direction. Consequently, the shaft 248 and material removal device 160 are also driven in a downward direction such that the material removal device 160 penetrates and passes through the stitchable material to remove material portions thereof. As a result, the material removal device 160 enters the bore 230 of the insert 228.

Figure 13:
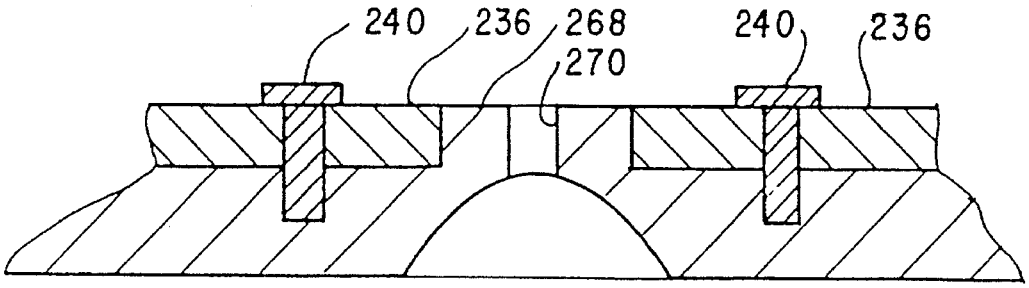
FIG. 13 is one embodiment of a table for interacting with a light duty material removal device.

As can be appreciated, when heavy duty stitchable materials are being subjected to the above-described material removal operations, particularly when relatively thick materials are being used, it may be necessary for the length of the bore 230 to be sufficiently long since there may be a tendency for these thicker materials to stretch during material removal operations. In this regard, a length of approximately ¼ inch for the bore 230 will accommodate for this stretching in most applications. However, when relatively light materials are subjected to material removal operations, the insert 268 of FIG. 13 may be utilized in which the length of the corresponding bore 272 therein is approximately 1/16 of an inch and is formed by doming out the lower portion of the insert 276. This insert 276 may be used in the base 232 discussed above (i.e., such that the portion disposal system 244 may be used therewith) or the insert may be used without the portion disposal system 244, such as in the above-described embodiment of the kit assembly 12 for removing material portions of stitchable material.

Once a material portion of the stitchable material has been removed in accordance with the above process, the portion disposal system 244 may be activated to carry away the removed portion. In this regard, a medium, again preferably air, in forced through the port 252 in the shaft 248 such that the air will pass through the inner cavity 256 and the material removal device 160 to propel the removed portion from the end of the device 160. Thereafter, the removed portion passes through the adapter 260 and conduit 264 to an appropriate receptacle (not shown) as discussed above.

A number of alternatives may be utilized for the sources of the mediums for moving the pistons 192 and for use in the portion disposal system 244. In a preferred embodiment, a pneumatic supply system (not shown) is utilized and separate lines (not shown) are used to supply air to the chambers 188 and the portion disposal system 244. This allows the pressure of air supplied to the chambers 188 and the disposal system 244 to be controlled independently. However, the air which is used to drive the pistons 192 in the downward direction, which is evacuated from the chambers 188 when air is applied to the lower ports 204 to reinitialize the positioning of the pistons 192 and thus the material removal device 160 after a single removal operation is completed, may be used to provide the air used by the portion disposal system 244. In this regard, a conduit (not shown) would interconnect one or both of the upper ports 200 with the port 252 in shaft 248 of the disposal system 244.

The above-described drive assembly 180 and portion disposal system 244 may also of course utilize well known electronic or other sensing techniques such that material removal operations and the disposal of the removed portions can be performed in an automated manner, together with the sewing operations, so as to take full advantage of the capabilities of the programmable sewing machine 16. Consequently, the portion disposal system 244 can be activated via these sensing capabilities (i.e., air supplied through the inner cavity 256 of the shaft 248 and through the interior of the material removal device 160) simultaneously with the contacting of the stitchable material by the material removal device 160 or soon thereafter. Preferably, however, the portion disposal system 244 is not activated until the material removal device 160 has completely passed through the stitchable material. This not only may assist in the retraction of the pistons 192, but it reduces the potential for the forced air having an adverse affect on the material removal operations. For instance, in the event that air is provided to the disposal system 244 prior to the material removal device 160 contacting the stitchable material, not only does this provide a braking action to the downward motion of the material cutting device 160 (i.e., by working against the action of the device 160), but it may also undesirably disturb and/or disfigure the stitchable material.

Although the portion disposal system 244 has been described with regard to using a table 224 and support assembly 216 which are detachably connectable to a programmable sewing machine 16 to in effect provide a kit for use with existing machines 16 which again does not require significant modification thereof, the portion disposal system 244 may of course be used with other material removal operation apparatus. For instance, the described portion disposal system 244 may be utilized on a programmable sewing machine 16 in which the casting of the machine 16 is formed to accommodate the permanent incorporation of a material removal system (i.e., a machine 16 in which the cylinder bed 36 effectively incorporates the table 216 and in which the head 24 permanently incorporates the drive assembly 180 for the material removal device 160).

Although the portion disposal system 244 has been described with reference to the use of air for carrying away the removed portion of stitchable material, those skilled in the art will appreciate that a number of alternatives exist for displacing the removed portion of stitchable material from an end of the material removal device 160. For instance, other pressurized fluids may be utilized. Moreover, the removed portion may be mechanically displaced from the material removal device 160. More particularly, a rod may be propelled through the interior portion of the material removal device 160 by an appropriate drive assembly.

Each of the above-identified embodiments may further include an assembly for aligning the stitchable material relative to the material removal device. That is, in certain applications the stitchable material which is to have material removal and sewing operations performed thereon already has one or more guide holes formed therein. The alignment feature of the present invention thereby improves upon the accuracy of the placement of the hole(s) in the stitchable material, as well as the sewing pattern around this hole(s).

Referring to FIG. 15–18, one embodiment of an alignment assembly 398 is illustrated therein as such could be integrated with the material removal device 160 and portion disposal system 244 of FIGS. 9–13. The alignment assembly 398 generally includes a cable 402 having a wire 404 slidably positioned therein. One end of the wire 404 is interconnected with a reciprocable piston of a pneumatic cylinder 410 which is mounted on the sewing machine 16. A second end of the wire 404 is aligned with the bore 230 in the table 224 through which the material removal device 160 travels. Consequently, as the piston of the cylinder 410 reciprocates in a predetermined manner between two positions (e.g., as controlled by appropriate software), the wire 404 moves relative to the cable 402 and the table 224 between two positions. In the alignment position of FIG. 16, the wire 404 extends above the surface of the table 224, and thus is in the path of travel of the material removal device 160. In the retracted position of FIG. 17, the wire 404 is below the table 224 and out of the path of travel of the material removal device 160 so as to not interfere with its operation.

Figure 18:
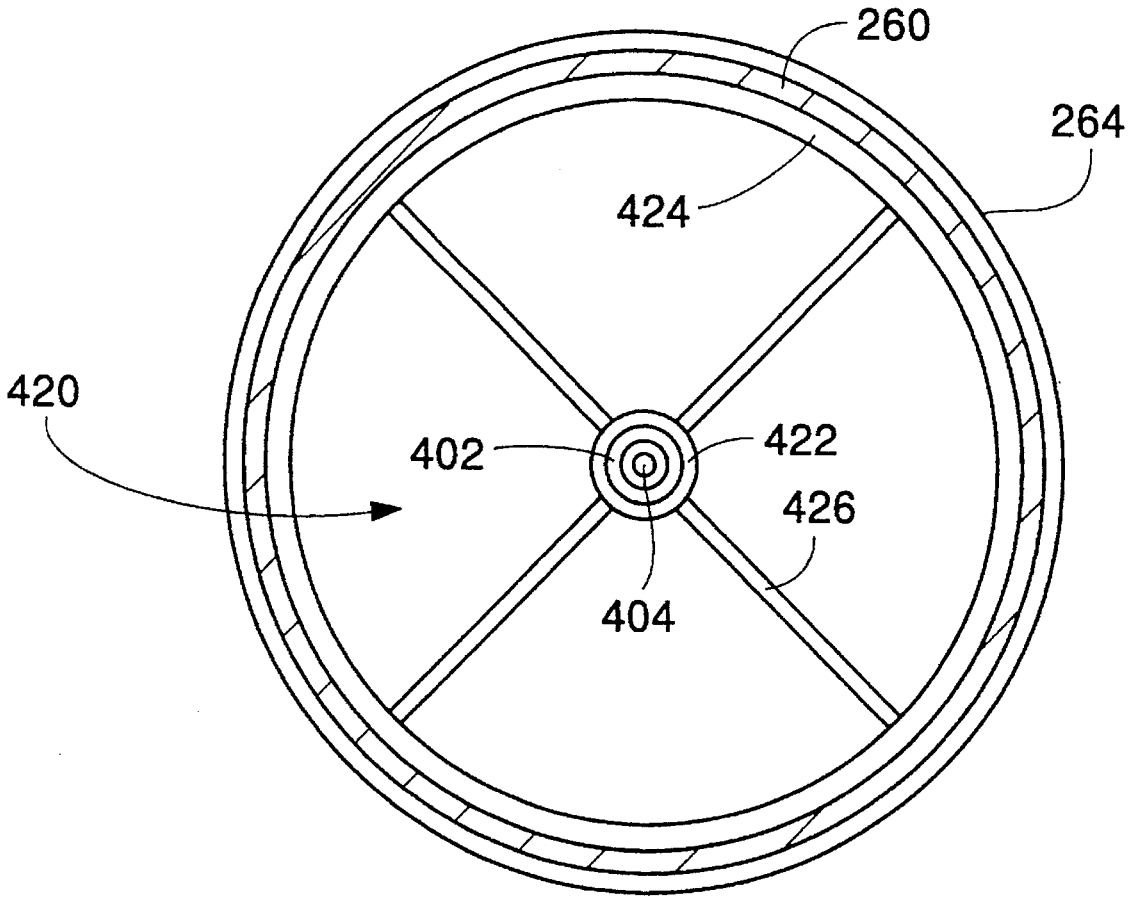
FIG. 18 is a cross-sectional view of the alignment assembly of FIG. 17 taken along lines 400—400.

As can be appreciated, the manner in which the alignment assembly 398 is incorporated should not interfere with the operation of the portion disposal system 244. In one embodiment, the cable 402 extends through conduit 264 and is secured to the bell-shaped adapter 260 by a bracket or a clamp assembly 420, and thus is maintained in a fixed position relative to the base 232 of the table 224. As illustrated in FIG. 18, the bracket assembly 420 preferably includes a centrally disposed annular hub 422, and an annular rim 424 connected by a plurality of spokes 426 extending radially from the hub 422 to the rim 424. The cable 402 is appropriately secured to the hub 422 and thus the wire 404 may move relative thereto. Moreover, since there is a space between adjacent spokes 426 this interconnects the alignment assembly 398 without interfering with material disposal operations as described above.

Figure 16:
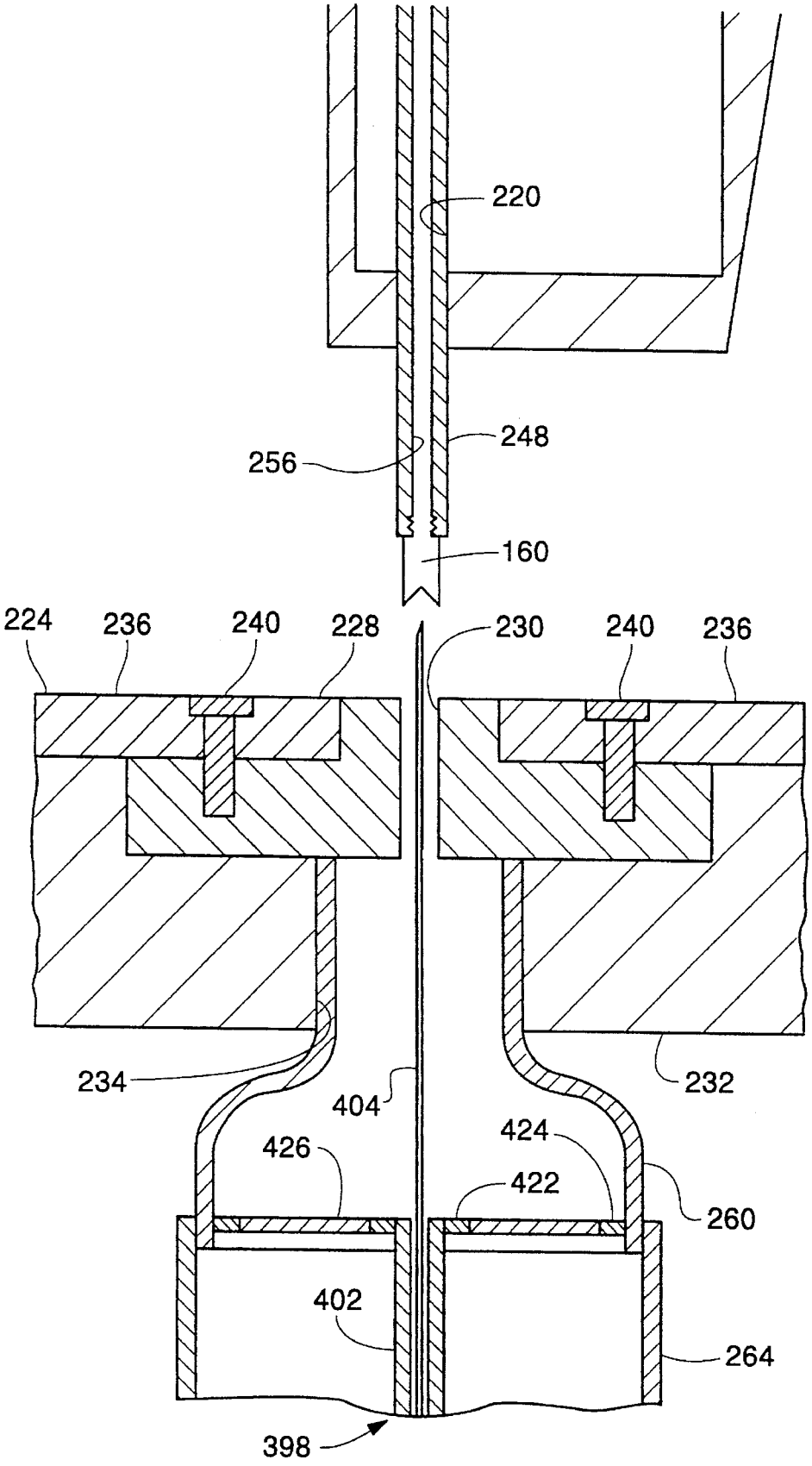
FIGS. 16 and 17 are cross-sectional views of the table of FIG. 12 incorporating the alignment assembly of FIG. 15.

In operation, the alignment assembly 398 is placed in a first position as illustrated in FIG. 16 and the stitchable material is positioned on the portion of wire 404 extending above base 232 using pre-existing guide or positioning holes in the stitchable material. The wire 404 is advanced relative to the cable 402 and the table 224 into this position by activation of the cylinder 410, more particularly by movement of its piston to a predetermined location. In this position, the wire 404 is once again in the path through which the material removal device 160 passes when performing material removal operations on the one or more pieces of stitchable material.

Figure 17:
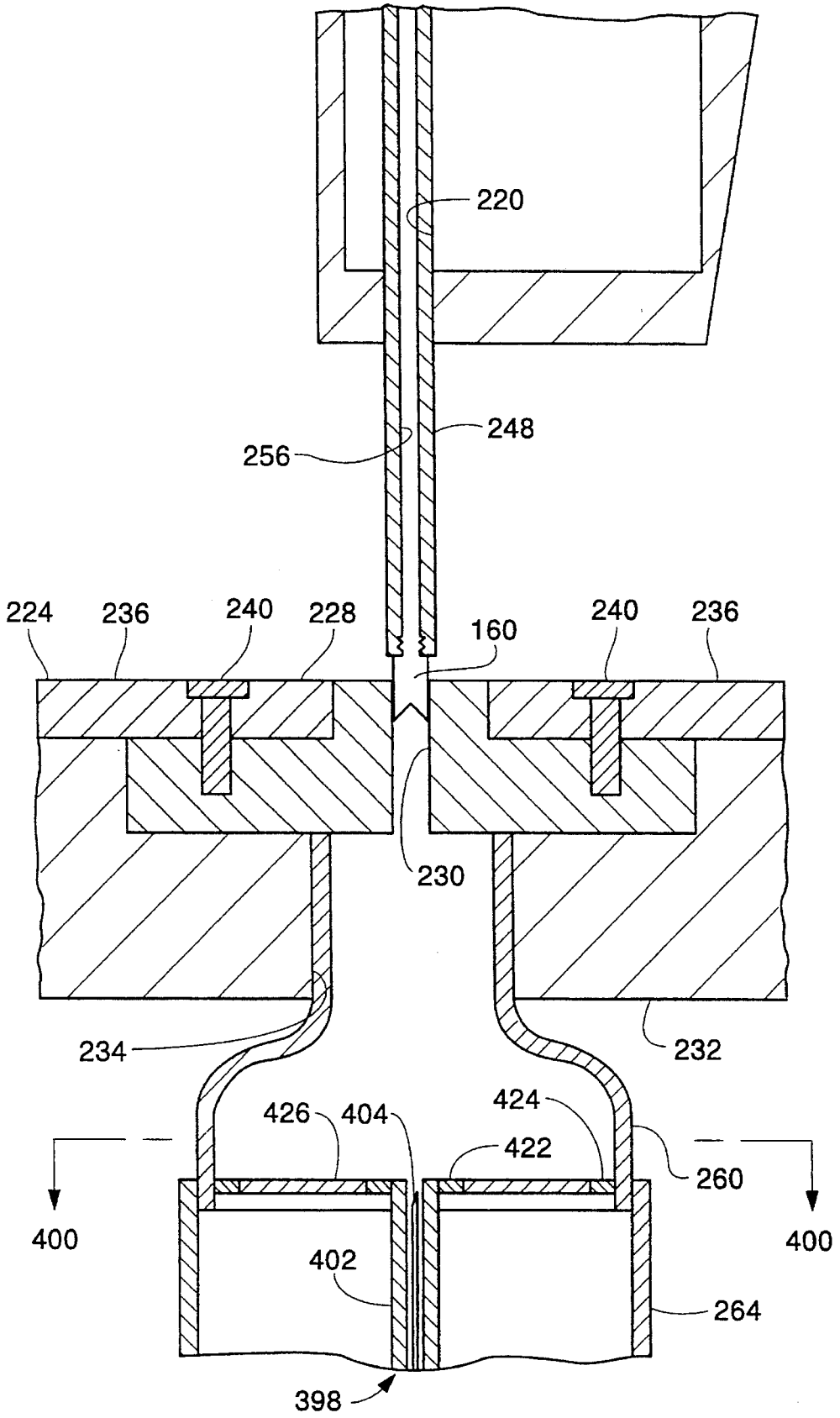

After the one or more pieces of stitchable material are mounted on the wire 404 when in the position illustrated in FIG. 16, the wire 404 is retracted beneath the surface of the table 224 and to a location which is outside of the path of travel of the material removal device 160 so as to not interfere with material removal operations as illustrated in FIG. 17. This movement of the wire 404 is affected by activation of the cylinder 410, more particularly by movement of its piston to another predetermined location which thereby moves the wire 404 relative to the cable 402 and the table 224. Thereafter, material removal and sewing operations may be performed in the above-described manner.

Notwithstanding the foregoing description of how the wire 404 may be moved between the two noted positions, it will be appreciated that other appropriate mechanisms may be utilized. For instance, the wire 404 may be appropriately interconnected with the presser foot assembly 60 of the programmable sewing machine 16. More particularly, when the upper presser foot 64 moves down into engagement with the stitchable material prior to the performance of material removal operations, an appropriate linkage between the upper presser foot 64 and the wire 404 could retract the wire 404 into the position illustrated in FIG. 17. Moreover, when the upper presser foot 64 is raised, for instance to allow for the removal of stitchable material after sewing operations have been completed and/or to insert one or more new pieces of stitchable material for the performance of material removal and sewing operations thereon, the noted linkage would raise the wire 404 into its alignment position as illustrated in FIG. 16.

In addition to the foregoing, it will be appreciated that other mechanical devices may be used to perform the alignment function noted herein. For instance, instead of a wire 404 a pin or the like of sufficient rigidity could be used and moved between the two noted positions to provide an alignment function. Moreover, although only one alignment device is illustrated, it will be appreciated that multiple alignment devices may be used if multiple guide holes are provided in the stitchable material for indicating the location of the desired holes. That is, an alignment assembly may include multiple members which are movable between the two noted positions. Furthermore, it will be appreciated that the alignment assembly 398 may be used when a guide hole(s) is present in the one or more pieces of stitchable material wherein the size of such hole(s) is increased by the material removal device 160, or the alignment assembly 398 may be used to align a prepunched hole at a location which is displaced from the sewing needle 56 of the sewing machine 16. That is, material removal operations need not necessarily be performed when using the alignment assembly 398.

The foregoing description of the invention has been presented for purposes of illustration and description. Further, the description is not intended to limit the invention to the form disclosed herein. Consequently, variations and modifications commensurate with the above teachings, in the skill or knowledge of the art, are within the scope of the present invention. The embodiments described hereinabove are further intended to explain best modes known of practicing the invention and to enable others skilled in the art to utilize the invention in such, or other, embodiments and with the various modifications required by their particular applications or uses of the invention. It is intended that the appended claims be construed to include alternative embodiments to the extent permitted by the prior art.

What is claimed is:

1. A sewing and material removal assembly for use with a plurality of plies of a stitchable material, comprising:

a sewing unit comprising a sewing needle;

a material removal unit laterally displaced from said sewing needle and comprising a material removal device and a receiving table with an aperture aligned with said material removal device;

means for transferring the stitchable material between said sewing unit and said material removal unit; and means for aligning the plurality of plies of a stitchable material in a predetermined position relative to said material removal device, said means for aligning comprising means for restricting movement in at least one dimension of each ply comprising the plurality of plies, said means for aligning being disposed within said aperture and extending above said receiving table.

2. An assembly, as claimed in claim 1, further comprising:

means for moving said means for aligning between first and second positions, said means for aligning being within a path of travel of said material removal device when in said first position, said means for aligning being outside a path of travel of said material removal device when in said second position.

3. An assembly, as claimed in claim 1, further comprising:

means for moving said means for aligning between first and second positions, wherein said means for aligning extends through said aperture and above said receiving table when in said first position, and wherein said means for aligning is positioned below said receiving table when in said second position.

4. An assembly, as claimed in claim 1, wherein:

said means for aligning comprises a substantially rigid member.

5. An assembly, as claimed in claim 1, wherein said means for aligning comprises:

a conduit interconnected with said receiving table;

a wire slidably received within said conduit;

means for moving said wire between first and second positions.

6. An assembly, as claimed in claim 5, wherein:

said means for moving said wire comprises a pneumatic cylinder interconnected with said wire.

7. An assembly, as claimed in claim 5, wherein:

said means for transferring comprises a presser foot assembly capable of three-dimensional movement along an x-axis, a y-axis, and a z-axis, said z-axis being vertical, said means for moving said wire being interconnected with said presser foot assembly and activated by movement of said presser foot assembly along said z-axis.

8. A sewing and material removal assembly for use with a stitchable material, comprising:

a sewing unit comprising a sewing needle, a throat plate, and a sewing area below said throat plate which contains components which interact with said sewing needle for performing sewing operations on the stitchable material;

a first material removal unit laterally displaced from said sewing area;

means for isolating said first material removal unit from said sewing area, said means for isolating comprising means for substantially enclosing said sewing area relative to said first material removal unit; and first means for transferring the stitchable material between said sewing unit and said first material removal unit, said first means interconnecting said sewing unit and said first material removal unit.

9. An assembly, as claimed in claim 8, further comprising:

a second material removal unit laterally displaced from said sewing area and means for isolating said second material unit from said sewing area, said first and second material removal units being positioned on substantially opposite sides of said sewing unit.

10. An assembly, as claimed in claim 9, further comprising:

second means for transferring the stitchable material between said sewing machine and said second material removal unit, said first and second means alternately providing stitchable material to said sewing unit.

11. An assembly, as claimed in claim 8, wherein:

said first material removal unit is separable from said sewing unit.

12. An assembly, as claimed in claim 8, wherein:

said first material removal unit comprises a first material removal device for creating at least one opening in the stitchable material and a table comprising an aperture associated with each opening to be made in the stitchable material by said first material removal device.

13. A method for performing sewing and material removal operations on a piece of stitchable material having at least one guide hole therein, comprising the steps of:

transporting the stitchable material to a material removal unit comprising a material removal device;

mechanically aligning the at least one guide hole in the stitchable material with said material removal device;

making a finished hole in the stitchable material using said material removal device, said making step comprising enlarging the size of the at least one guide hole;

transporting the stitchable material to a sewing unit after said enlarging step; and sewing a pattern about the at least one hole with said sewing unit.

14. A method, as claimed in claim 13, wherein:

said material removal unit comprises a receiving table with an aperture aligned with said material removal device, said mechanically aligning step comprising projecting a member through said aperture above said receiving table.

15. A method, as claimed in claim 14, further comprising the step of:

retracting said member after said mechanically aligning step, wherein said member does not interfere with said material removal device.

16. A method, as claimed in claim 14, wherein:

said aligning step comprises substantially matching a diameter of said member with a diameter of the at least one guide hole.

17. A sewing and material removal assembly for use with stitchable material, comprising:

a sewing unit comprising a sewing needle;

a material removal unit laterally displaced from said sewing needle and comprising a material removal device and a receiving table with an aperture aligned with said material removal device;

means for transferring the stitchable material between said sewing unit and said material removal unit;

means for aligning the stitchable material in a predetermined position relative to said material removal device, said means for aligning being disposed within said aperture and extending above said receiving table; and means for moving said means for aligning between first and second positions, said means for aligning being within a path of travel of said material removal device when in said first position, said means for aligning being outside a path of travel of said material removal device when in said second position.

18. An assembly, as claimed in claim 17, wherein:

said means for aligning extends through said aperture and above said receiving table when in said first position, and wherein said means for aligning is positioned below said receiving table when in said second position.

19. An assembly, as claimed in claim 17, wherein:

said means for aligning comprises a substantially rigid member.

20. An assembly, as claimed in claim 17, wherein said means for aligning comprises:

a conduit interconnected with said receiving table;

a wire slidably received within said conduit; and means for moving said wire between first and second positions.

21. An assembly, as claimed in claim 20, wherein:

said means for moving said wire comprises a pneumatic cylinder interconnected with said wire.

22. An assembly, as claimed in claim 20, wherein:

said means for transferring comprises a presser foot assembly capable of three-dimensional movement along an x-axis, a y-axis, and a z-axis, said z-axis being vertical, said means for moving said wire being interconnected with said presser foot assembly and activated by movement of said presser foot assembly along said z-axis.

23. A sewing and material removal assembly for use with stitchable material, comprising:

a sewing unit comprising a sewing needle;

a material removal unit laterally displaced from said sewing needle and comprising a material removal device and a receiving table with an aperture aligned with said material removal device;

means for transferring the stitchable material between said sewing unit and said material removal unit;

means for aligning the stitchable material in a predetermined position relative to said material removal device, said means for aligning being disposed within said aperture and extending above said receiving table; and means for moving said means for aligning between first and second positions, wherein said means for aligning extends through said aperture and above said receiving table when in said first position, and wherein said means for aligning is positioned below said receiving table when in said second position.

24. An assembly, as claimed in claim 23, wherein:

said means for aligning is within a path of travel of said material removal device when in said first position and said means for aligning is outside a path of travel of said material removal device when in said second position.

25. An assembly, as claimed in claim 23, wherein:

said means for aligning comprises a substantially rigid member.

26. An assembly, as claimed in claim 23, wherein said means for aligning comprises:

a conduit interconnected with said receiving table;

a wire slidably received within said conduit; and means for moving said wire between first and second positions.

27. An assembly, as claimed in claim 26, wherein:

said means for moving said wire comprises a pneumatic cylinder interconnected with said wire.

28. An assembly, as claimed in claim 26, wherein:

said means for transferring comprises a presser foot assembly capable of three-dimensional movement along an x-axis, a y-axis, and a z-axis, said z-axis being vertical, said means for moving said wire being interconnected with said presser foot assembly and activated by movement of said presser foot assembly along said z-axis.

29. A sewing and material removal assembly for use with stitchable material, comprising:

a sewing unit comprising a sewing needle;

a material removal unit laterally displaced from said sewing needle and comprising a material removal device and a receiving table with an aperture aligned with said material removal device;

means for transferring the stitchable material between said sewing unit and said material removal unit; and means for aligning the stitchable material in a predetermined position relative to said material removal device, wherein said means for aligning comprises:

a conduit interconnected with said receiving table;

a wire slidably received within said conduit; and means for moving said wire between first and second positions.

30. An assembly, as claimed in claim 29, wherein:

said means for moving said wire comprises a pneumatic cylinder interconnected with said wire.

31. An assembly, as claimed in claim 29, wherein:

said means for transferring comprises a presser foot assembly capable of three-dimensional movement along an x-axis, a y-axis, and a z-axis, said z-axis being vertical, said means for moving said wire being interconnected with said presser foot assembly and activated by movement of said presser foot assembly along said z-axis.

32. A sewing and material removal assembly for use with a stitchable material, comprising:

a sewing unit comprising a sewing needle, a throat plate, and a sewing area below said throat plate which contains components which interact with said sewing needle for performing sewing operations on the stitchable material;

a first material removal unit laterally displaced from said sewing area;

means for isolating said first material removal unit from said sewing area;

first means for transferring the stitchable material between said sewing unit and said first material removal unit, said first means interconnecting said sewing unit and said first material removal unit; and a second material removal unit laterally displaced from said sewing area and means for isolating said second material unit from said sewing area, said first and second material removal units being positioned on substantially opposite sides of said sewing unit.

33. An assembly, as claimed in claim 32, further comprising:

second means for transferring the stitchable material between said sewing machine and said second material removal unit, said first and second means alternately providing stitchable material to said sewing unit.

34. An assembly, as claimed in claim 32, wherein:

said first material removal unit is separable from said sewing unit.

35. An assembly, as claimed in claim 32, wherein:

said first material removal unit comprises a first material removal device for creating at least one opening in the stitchable material and a table comprising an aperture associated with each opening to be made in the stitchable material by said first material removal device.

* * * * *